US008376832B2

(12) United States Patent
O'Connor et al.

(10) Patent No.: US 8,376,832 B2
(45) Date of Patent: Feb. 19, 2013

(54) GAMING SYSTEM HAVING DYNAMICALLY TRANSLUCENT SYMBOL BACKGROUNDS

(75) Inventors: Michael O'Connor, San Francisco, CA (US); Anthony Prohl, Romeoville, IL (US); Michael Sesterhenn, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 554 days.

(21) Appl. No.: 12/524,304

(22) PCT Filed: Feb. 1, 2008

(86) PCT No.: PCT/US2008/001360

§ 371 (c)(1),
(2), (4) Date: Jul. 23, 2009

(87) PCT Pub. No.: WO2008/097470

PCT Pub. Date: Aug. 14, 2008

(65) Prior Publication Data

US 2010/0099482 A1 Apr. 22, 2010

Related U.S. Application Data

(60) Provisional application No. 60/899,745, filed on Feb. 6, 2007, provisional application No. 60/965,579, filed on Aug. 21, 2007.

(51) Int. Cl.
*A63F 9/24* (2006.01)

(52) U.S. Cl. ..... 463/20; 463/16; 463/30; 463/42

(58) Field of Classification Search ..... 463/16, 463/20, 30, 42

See application file for complete search history.

(56) References Cited

U.S. PATENT DOCUMENTS

| | | | | |
|---|---|---|---|---|
| 5,766,074 | A | 6/1998 | Cannon et al. | 463/16 |
| 6,293,865 | B1 | 9/2001 | Kelly et al. | 463/16 |
| 6,319,124 | B1 | 11/2001 | Baerlocher et al. | 463/20 |
| 6,558,254 | B2 | 5/2003 | Baelocher et al. | 463/20 |
| 6,692,356 | B2 | 2/2004 | Baerlocher et al. | 463/20 |
| 7,115,033 | B1 | 10/2006 | Timperley | 463/20 |
| 2002/0123378 | A1 | 9/2002 | Bucknall et al. | 463/16 |
| 2006/0068887 | A1 | 3/2006 | Pryor et al. | 463/20 |
| 2006/0154730 | A1 * | 7/2006 | Okuniewicz | 463/43 |
| 2007/0111788 | A1 | 5/2007 | Bucknall et al. | 463/30 |
| 2008/0026830 | A1 * | 1/2008 | Laut | 463/25 |
| 2009/0111578 | A1 * | 4/2009 | Griswold et al. | 463/31 |
| 2010/0311502 | A1 * | 12/2010 | Miller et al. | 463/30 |

FOREIGN PATENT DOCUMENTS

EP 1 304 667 A 4/2003

OTHER PUBLICATIONS

PCT International Search Report for International Application No. PCT/US2008/001360 dated Aug. 18, 2008 (3 pages).
PCT International Written Opinion for International Application No. PCT/US2008/001360 dated Aug. 18, 2008 (6 pages).

* cited by examiner

*Primary Examiner* — Pierre Eddy Elisca
*Assistant Examiner* — Shahid Kamal
(74) *Attorney, Agent, or Firm* — Nixon Peabody LLP

(57) ABSTRACT

A gaming system comprises a wager input device and a display for displaying a wallpaper, a plurality of symbols, and a plurality of symbol backgrounds. The symbols overly the symbol backgrounds, and the symbol backgrounds overly the wallpaper. The plurality of symbols represent a randomly selected outcome of a wagering game. The system further comprises a controller operative to increase a translucence of at least one of the symbol backgrounds to increase visibility of the wallpaper in response to a triggering event.

26 Claims, 22 Drawing Sheets

GAMING SYSTEM HAVING DYNAMICALLY TRANSLUCENT SYMBOL BACKGROUNDS

CROSS REFERENCE TO RELATED APPLICATIONS

This application is a U.S. national stage of International Application No. PCT/US2008/001360, titled "Gaming System Having Dynamically Translucent Symbol Backgrounds" and filed Feb. 1, 2008, which claims priority to U.S. Provisional Patent Application Ser. No. 60/899,745, titled "Gaming System Having Dynamically Translucent Symbol Backgrounds" and filed on Feb. 6, 2007, and to U.S. Provisional Patent Application Ser. No. 60/965,579, titled "Gaming System Having Dynamically Translucent Symbol Backgrounds" and filed on Aug. 21, 2007, each of which is incorporated herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming system having dynamically translucent symbol backgrounds.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming systems with new types of bonus games to satisfy the demands of players and operators.

Traditionally, gaming machines utilize symbols with fixed backgrounds of various colors and graphics. Moreover, some gaming machines utilize background scenes or wallpapers. One problem that arises is that the symbol backgrounds and background scenes are static such that the one overlies the other blocking portions of the backgrounds from view. Another problem that exists is that the backgrounds of symbols in winning combinations are often indistinguishable from backgrounds of symbols not included in such winning combinations, thereby making it difficult for a player to perceive the winning combination displayed. Yet another problem created is that symbols with fixed backgrounds are often of relatively smaller size so as to permit viewing of the background scene on the gaming machine. However, this detracts from the aesthetics of the symbols themselves. The present invention is directed to solving these and other problems.

SUMMARY OF THE INVENTION

According to one aspect of the present invention, a gaming system comprises a wager input device and a display for displaying a wallpaper, a plurality of symbols, and a plurality of symbol backgrounds. The symbols overly the symbol backgrounds, and the symbol backgrounds overly the wallpaper. The plurality of symbols represent a randomly selected outcome of a wagering game. The system further comprises a controller operative to increase a translucence of at least one of the symbol backgrounds to increase visibility of the wallpaper in response to a triggering event.

According to another aspect of the invention, a method of conducting a wagering game on a gaming system comprises receiving a wager and displaying a wallpaper, a plurality of symbols, and a plurality of symbol backgrounds, the symbols overlying the symbol backgrounds, the symbol backgrounds overlying the wallpaper. The plurality of symbols represent a randomly selected outcome of a wagering game. The method further comprises detecting a triggering event and in response to the triggering event, changing a first translucence of a first one of the symbol backgrounds to increase the visibility of the wallpaper in response to a triggering event.

According to yet another aspect of the invention, a method of conducting a wagering game on a gaming system comprises receiving a wager and displaying a wallpaper and a matrix of symbols, the symbols overlying a plurality of symbol backgrounds, the symbol backgrounds overlying the wallpaper. The matrix is bordered by a symbol window. The plurality of symbols represent a randomly selected outcome of a wagering game, the randomly selected outcome selected from a plurality of possible outcomes including at least one winning outcome, the winning outcome comprising a plurality of winning symbols. The method further comprises detecting if the randomly selected outcome is the at least one winning outcome, and if so, increasing a first translucence of the symbol backgrounds of the winning symbols.

According to yet another aspect of the invention, a method of conducting a wagering game on a gaming system comprises receiving a wager and displaying an animated background scene having a plurality of awards. The method further comprises overlying the background scene with a primary wagering game, the primary wagering game including a matrix of symbols, the background scene visible through the matrix of symbols. The method further comprises continuing animation of the background scene during one or more plays of the wagering game, and upon the occurrence of a triggering event, removing the matrix of symbols to display a bonus event, the bonus event including continued display of the animated background scene.

According to yet another aspect of the invention, a computer readable storage medium is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
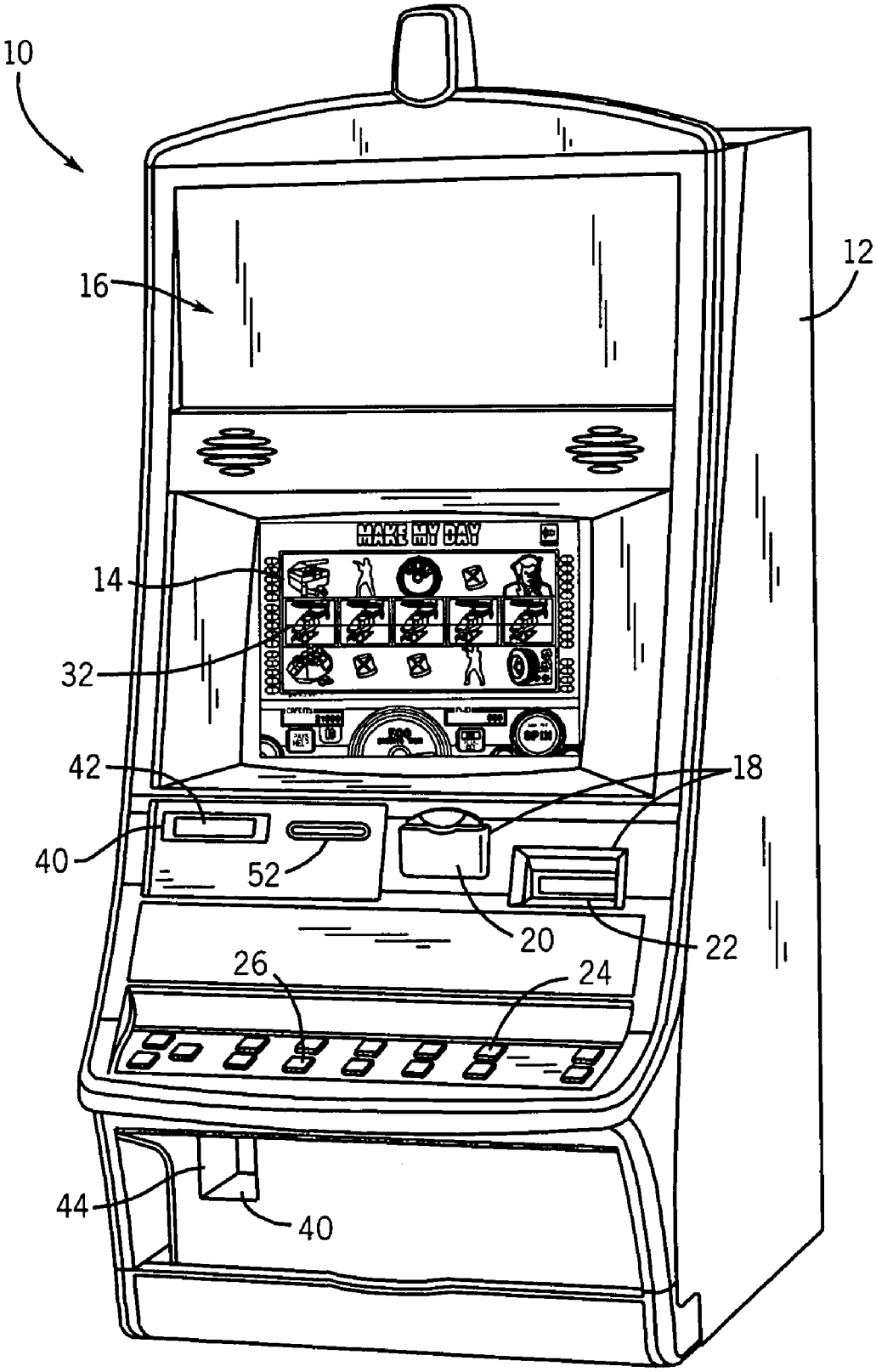
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
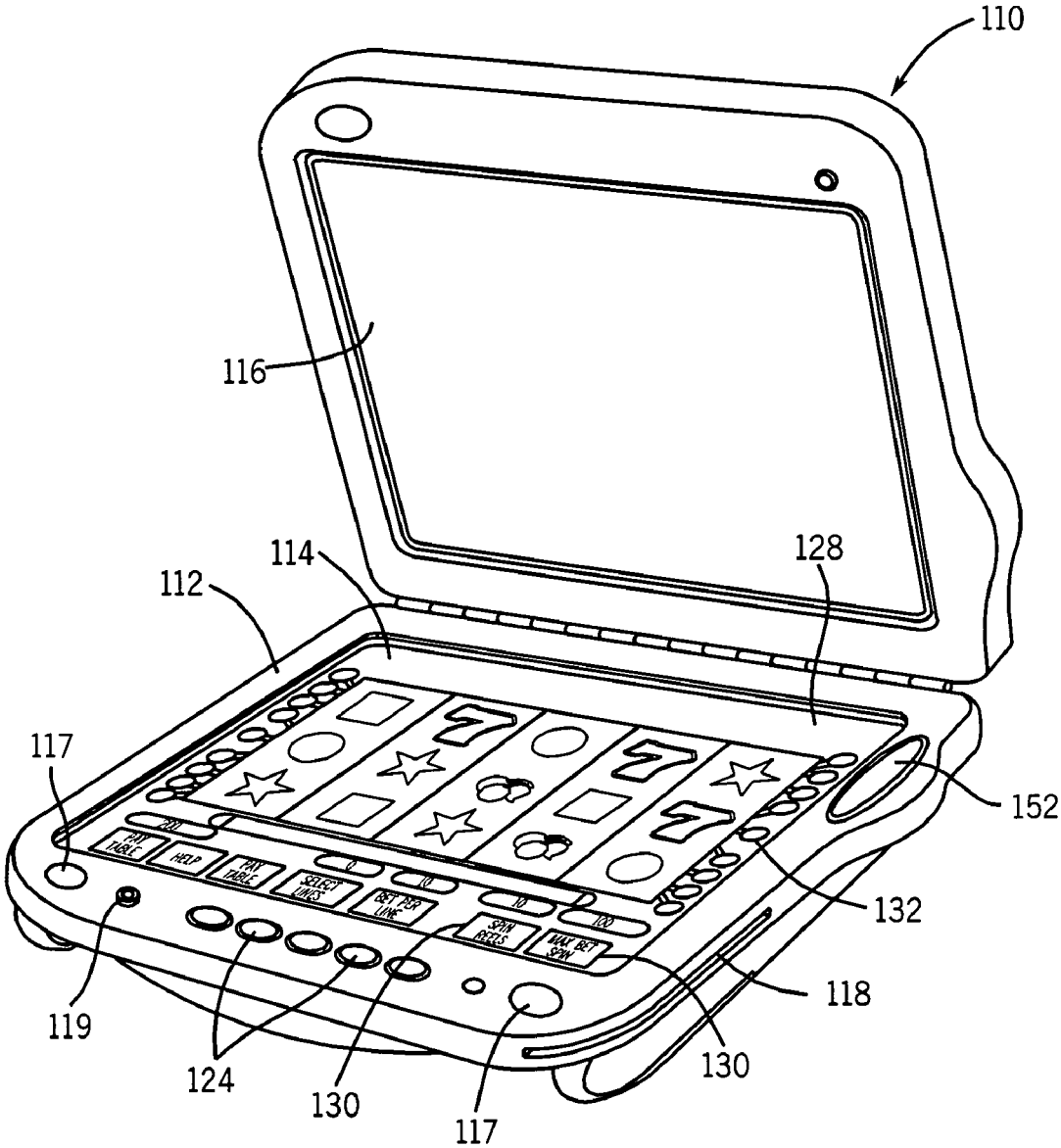
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen mounted to a primary display 114 and/or secondary display 116. In one aspect, the touch screen is matched to a display screen having one or more selectable touch keys 130 selectable by a user's touching of the associated area of the screen using a finger or a tool, such as a stylus pointer. A player enables a desired function either by touching the touch screen at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
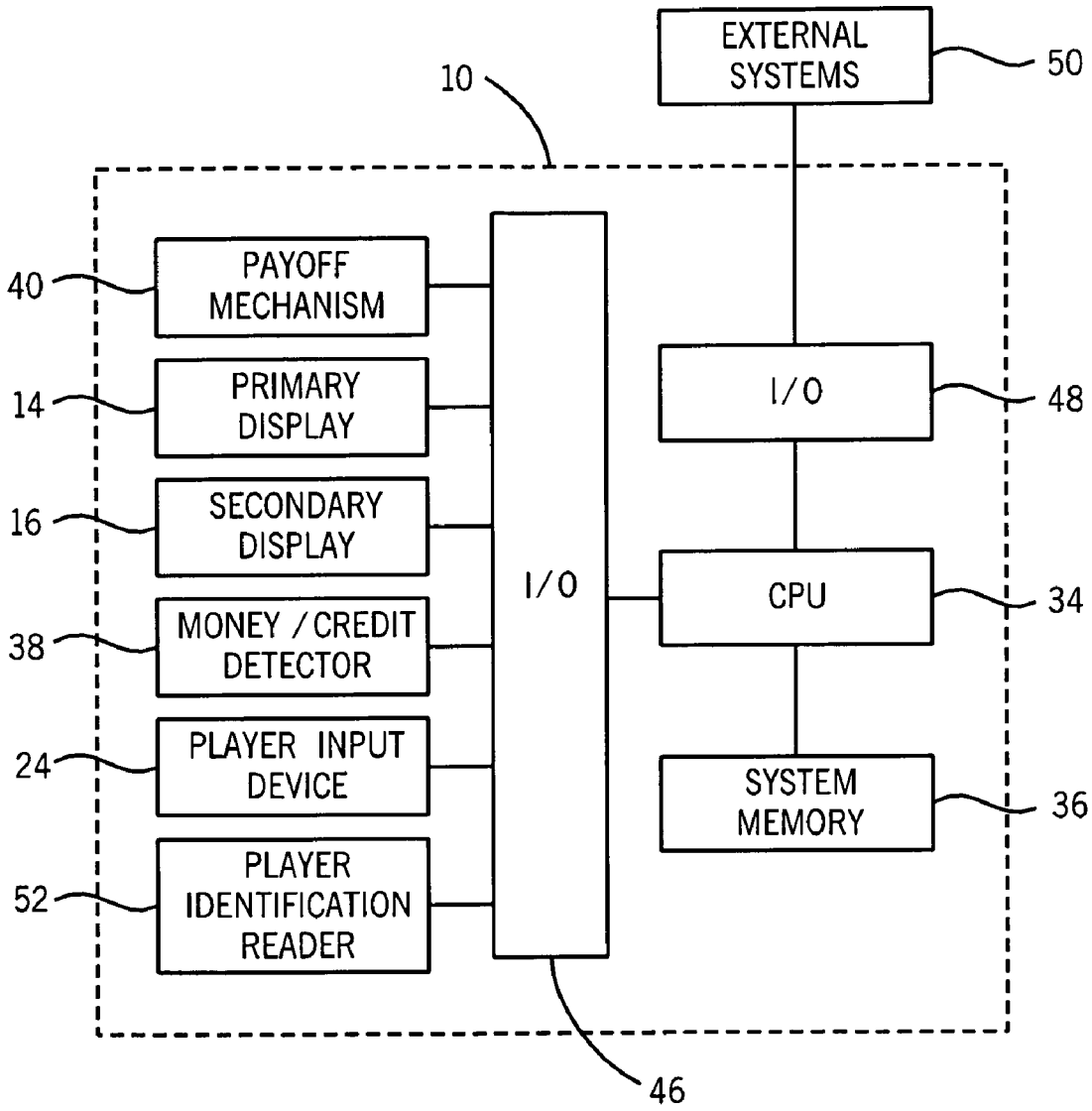
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10 bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality there between. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
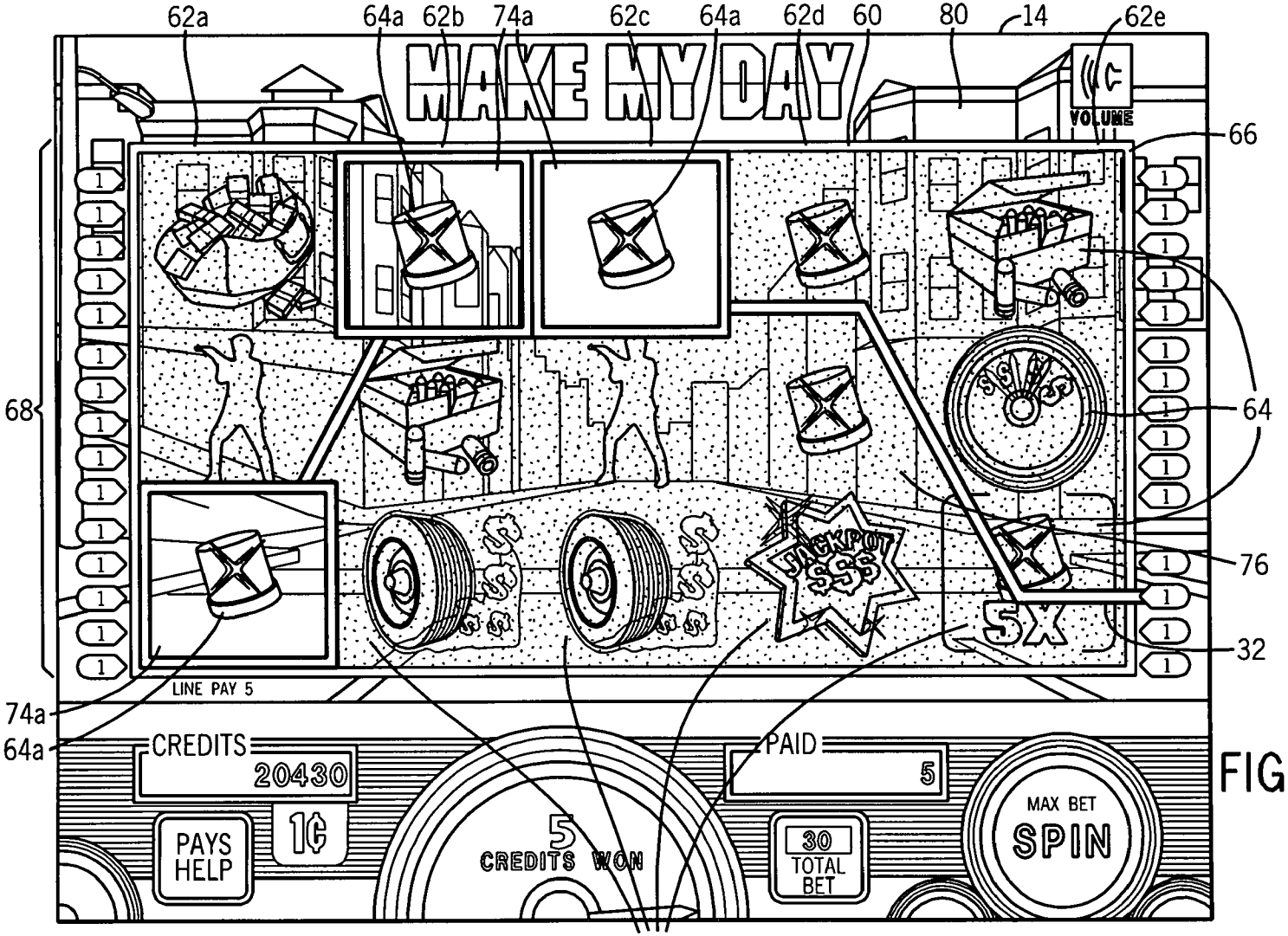
FIG. 3 is a front view of the display of a gaming system having dynamically translucent symbol backgrounds.

Turning now to FIG. 3, the primary display 14 of a gaming device displaying a wagering game according to the present invention is shown. The wagering game may be displayed on the display 14 of a free standing gaming machine 10 as shown in FIGS. 1*a* and 3, or on the display 114 of a handheld gaming machine 110 as seen in FIG. 1*b*. The display 14 in FIG. 3 includes a wagering game 60, which in this embodiment is a slot game. The slot game 60 includes a plurality of reels 62*a,b,c,d,e*. The reels 62 may be either electro mechanical reels or video simulations thereof. In the embodiments shown in the FIGURES, the primary display 14 is an LCD display and the reels 62 are video simulations depicted thereon. The reels 62 include a plurality of primary symbols 64 displayed thereon. One or more paylines 32 pass through and extend across the reels 62. As described herein the symbols 64 landing on the active paylines 32 (the paylines for which a wager has been received) are evaluated for winning combinations. If a winning combination of symbols 64 lands on an active payline 32, a primary award is awarded in accordance with a paytable of the gaming device.

As seen in FIG. 3, the five reels 62 are positioned within a symbol window 66, which borders the reels 62 and the symbols 64 displayed thereon. In this embodiment, a matrix 68 of fifteen symbols 64 are displayed inside of the symbol window 66 surrounding the five reels 62. The matrix 68 of symbols includes three rows and five columns of symbols 64. The symbol window 66 surrounds or borders a plurality of symbol backgrounds 74 which together form a unified background layer 76 (shown as a dotted layer in FIG. 3), which in this embodiment extends behind the symbols 64 to the edges of the symbol window 66. The symbol backgrounds 74 are overlaid by the individual symbols 64 in the matrix 68.

The display 14 also depicts a background scene or wallpaper 80 which is displayed behind the symbols 64 and the symbol backgrounds 74. In this embodiment, the wallpaper 80 is larger than the symbol window 66 and extends beyond the boundaries of the symbol window 66 so that it can be seen outside of the window 66. In alternate embodiments the wallpaper 80 may be larger, smaller or the same size as the symbol window 66. The wallpaper 80 comprises a background scene, which in an embodiment, is thematically related to a theme of the gaming device 10. As seen in FIG. 3, the theme of the gaming machine is a "Make My Day" police detective theme, and the wallpaper 80 depicts a background scene of city streets and buildings where the action of the thematic story takes place. The wallpaper 80 may be static depicting a fixed view or picture of the background scene, or may be dynamic depicting multiple views, or a moving view of the background scene, for example, by use of a virtual camera. Moreover, the wallpaper 80 may be depicted as a two dimensional image or may be a 3-D image rendered by capturing one or more views from one or more virtual cameras.

As seen in FIG. 3, the symbols backgrounds 74, and background layer 76 may take on a variety of different translucencies or transparencies. In the embodiment shown in FIG. 3, the symbol backgrounds 74 include two states: a nearly opaque state and a substantially transparent state. Some of the symbol backgrounds 74*a* are shown in a substantially transparent state such that the wallpaper 80 is entirely visible through the backgrounds 74*a*. Other symbol backgrounds 74*b* are shown in a nearly opaque state such that the wallpaper 80 is still visible through the backgrounds 74*b*, but the backgrounds 74*b* have been darkened or shaded to the point of being nearly opaque such that the wallpaper 80, although visible, is considerably less visible than through the transparent backgrounds 74*a*. Stated differently, the backgrounds 74 may be shown with different levels of translucence. The transparent, or nearly transparent symbol backgrounds 74*a* have a very high level of translucence, thereby allowing large levels of light to pass through, and allowing much clearer and greater visibility of the wallpaper 80 features located behind such highly translucent background 74*a*. The nearly opaque symbol backgrounds 74*b* have a very low level of translucence, thereby allowing only small levels of light to pass through, and restricting visibility and clarity of the wallpaper 80 features located behind such low translucent backgrounds 74*b*. It should be understood that the symbol backgrounds 74 may be given any level of translucence from completely opaque (not translucent at all), to completely transparent, or any level of translucence in between.

In the embodiment shown in FIG. 3, high translucence symbol backgrounds 74*a* are used to signify winning combinations of symbols 64 of the wagering game 60, while low translucence symbol backgrounds 74*b* are associated with non-winning symbols 64 in the matrix 68. For example, on a single play of the wagering game 60, the player inputs a wager sufficient to activate the desired number of paylines 32 which the player wishes to play, and then initiates a play of the wagering game 60 (for example, by pressing a "spin" button). The symbols 64 are varied by spinning and stopping the reels 62 so as to display a resulting matrix 68 of symbols 64 which form the outcome of the play of the wagering game 60. The outcome of symbols 64 in the matrix 68 may include winning combinations of symbols 64, as seen in FIG. 3. In this embodiment a winning combination of symbols 64 is three or more adjacent symbols 64 on an active payline 32. Thus, in FIG. 3, the three "siren" symbols 64*a* are a winning combination on an active payline 32, and a corresponding award is paid to the player for achieving the winning combination.

Prior to, and during the spin of the reels 62, the symbol backgrounds 74 of all of the symbols 64 are depicted as nearly opaque, or having a low translucence. Once the reels 62 have stopped spinning and the symbols 64 forming the outcome of the wagering game 60 are displayed, the symbols backgrounds 74*a* for the three "siren" symbols 64*a* have been changed from a low translucence to a high translucence, or in this instance transparent. Thus, symbols 64 which are part of a winning combination are emphasized, highlighted, or signified by changing their respective symbol backgrounds 74 from low translucence to high translucence or transparent. This stresses the symbols 64 forming the winning combination to the player. Moreover, the transparent symbol backgrounds 74*a* permit the player an extra aesthetic award in that the player is provided a clearer view, or "sneak peek" at the wallpaper 80 behind the symbols 64. In this way, the player's enjoyment of the wagering game 60 increases as winning combinations provide both monetary awards and aesthetic awards.

Figure 4:
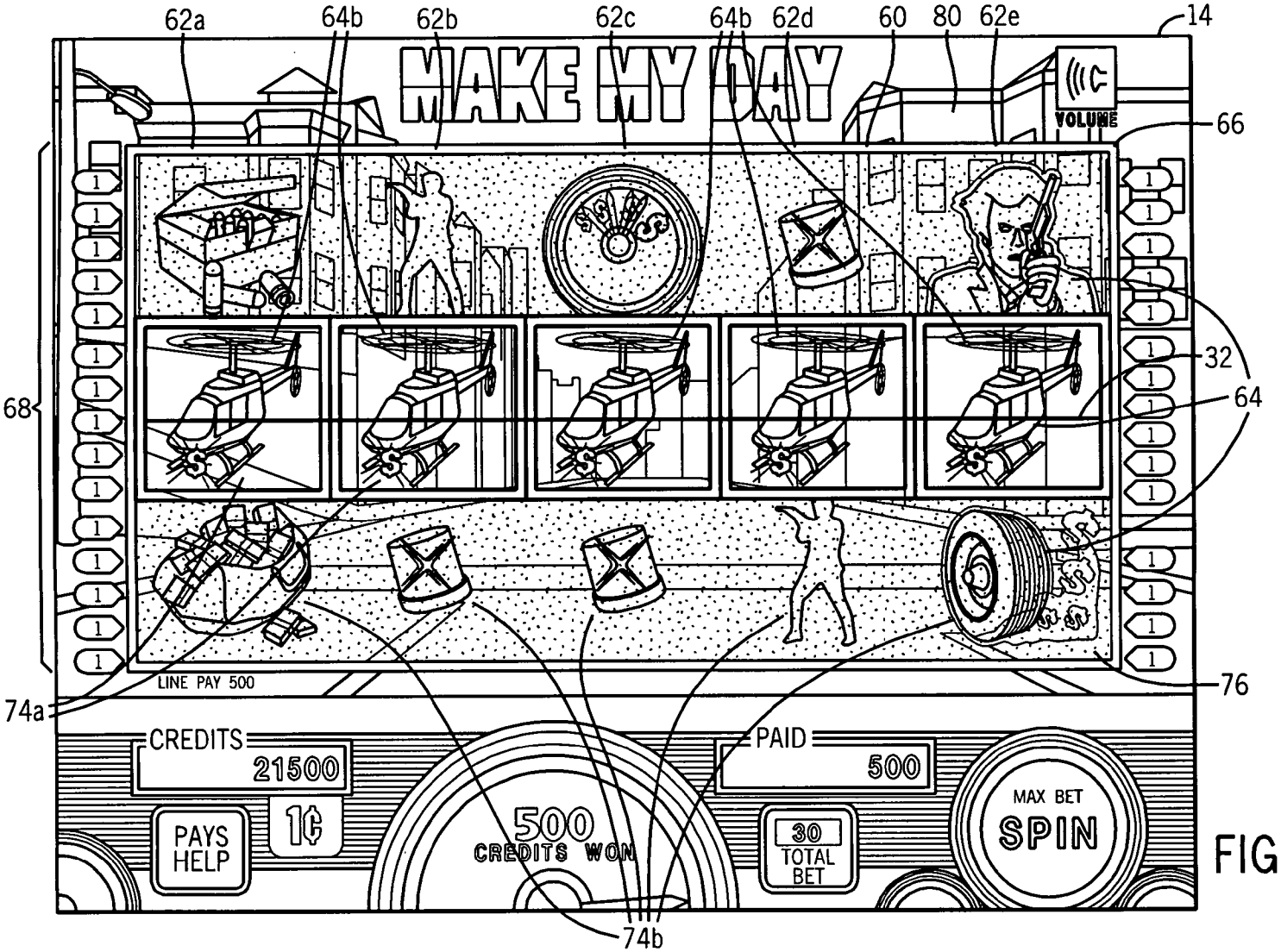
FIG. 4 is a front view of the display of the gaming system of FIG. 3 depicting the conclusion of another play of the wagering game.

In FIG. 4, the conclusion of another play of the wagering game 60 is depicted. On this play, five "helicopter" symbols 64*b* have landed on the center payline 32 which is active. Again, the player is awarded a monetary or credit award, as seen in the "Paid" credit meter which shows that 500 credits have been paid to the player. In addition, the symbol backgrounds 74*a* behind the five "helicopter" symbols 64*a* have been changed from low translucence to high translucence, or in this instance, transparent. The wallpaper 80 background scene is more clearly visible through the high translucence symbol backgrounds 74*a*, and thus more enjoyable to the player. In this embodiment, the wallpaper 80 again depicts streets and buildings from a city scene in which the "Make My Day" story takes place. In this embodiment, the more symbols 64 that are included in a winning combination, the more of the wallpaper 80 that is visible through low translucence symbols backgrounds 74*a* to the player.

In an embodiment, the control of the level of translucence of the symbol backgrounds 74 is performed using alpha compositing control of one or more processors of the gaming system 10. Compositing is the process of rendering image elements in separate passes and then combining the resulting images into a final image. To perform the compositing process, a matte for each image element is kept which contains coverage information, such as the shape of the image being drawn. The information in the matte, among other things, indicates which portions of the image are actually to be drawn and which portions are empty. An alpha channel is used to store matte information relating to the transparency of one or more pixels. Typically, the value of the alpha channel is between zero and one, where a value of zero means that the pixel has no coverage information (transparent) and a value of one means that the pixel is fully opaque. By assigning various alpha channel values to various portions of an image, differing components or layers of an image may have any variety of translucence from completely transparent to completely opaque, or anywhere in between. In one embodiment, the graphics generation of the gaming system 10 is programmed so that the wallpaper 80 ignores the transparency of the symbol 64 images. In this way, the wallpaper 80 image shows through any transparent or translucent portions of the symbol 64, which in the embodiments shown in the FIGURES are generally the symbol backgrounds. In other embodiments, other methods of graphical control may be used to accomplish the change in translucence of the symbol backgrounds 74.

Although in this embodiment, a winning combination of symbols 64 is used to trigger the change in translucence of the symbol backgrounds 74, other triggering mechanisms may also be used. For example, the translucence of the symbol backgrounds 74 may be changed to signify a near miss, a partial winning combination, a bonus symbol, or a special symbol (such as a wild symbol, multiplier symbol, etc.). Moreover, the triggering mechanism may be random, or according to a specified algorithm, pattern, function, or order. In addition, the translucence of the symbol backgrounds 74 may be used for other purposes than emphasizing or highlighting a winning combination. The translucence may be changed to provide random or predetermined graphical displays. The translucence may also be changed to emphasize or highlight certain special symbols, bonus triggers, etc. The changing of the translucence of the background symbols 74 may be triggered by and performed for many different purposes. Eligibility requirements may be placed on the translucence changing effects as well. For example, a player may be required to bet a certain amount, place a side bet, wager on a minimum number of paylines 32, etc. in order to be eligible to receive the graphical benefits of the changing translucence of the symbol backgrounds 74.

In alternative embodiments, the wallpaper 80 may be a scripted or dynamic moving scene or other series of graphics. Moreover, different winning combinations may trigger changes in the display of the wallpaper 80 such that the background scene is different depending on the outcome of the wagering game 60. Different wallpapers 80 may also be associated with different "levels" or "episodes" of the wagering game 60 such that as a player progresses through the levels and achieves or collects various awards, combinations, or assets, the wallpaper 80 may change accordingly. For example, in "higher" levels, the wallpaper 80 may be more intricate, detailed, dynamic, vivid, and enjoyable than in lower levels. In yet other embodiments, the wallpaper 80 background scene may be player selectable.

The symbols 64 in the matrix 68 may also be configured so as to interact with the wallpaper 80 if certain triggering criteria are satisfied. The symbols 64 of a winning combination may be permitted to interact with the wallpaper 80 for even further excitement and enjoyment. For example, in FIG. 4, after the five "helicopter" winning combination is achieved in the matrix 68, one or more of the helicopters from the winning symbols 64*b* may fly through the streets of the city shown in the wallpaper 80 background scene. In this way, the player is awarded with even more detailed and enjoyable graphical displays. Many other alternatives are possible as to the interaction of the overlying symbols 64 with the underlying wallpaper 80.

In other embodiments, the symbols 64 themselves may be transparent or translucent such that wallpaper 80, or portions thereof, are visible or viewable through the symbols 64. In such embodiments, the symbol backgrounds 74 may also be translucent or transparent, or may be opaque. The translucence of the symbols 64 may be controlled, changed, or activated in response to any one or more triggering events as explained herein. Such embodiments may be utilized where the symbols 64 graphically occupy larger areas such that the size of the symbol background 74 is diminished. In this way, the translucent symbols 64 may offer the translucent views of the underlying wallpaper 80 instead of, or in addition to, translucent symbol backgrounds 74. Moreover, the symbols 64 themselves may be thought of as comprising the symbol carrier and the symbol background 74. In this way, a "symbol" 64 is a composite of a carrier (for example the helicopter from the helicopter symbol 64*b*), and the symbol background 74*a* surrounding the symbol carrier. Therefore, portions of such a composite symbol may offer varying translucence. Such portions may include the symbol carrier or the symbol background, or both.

Figure 5:
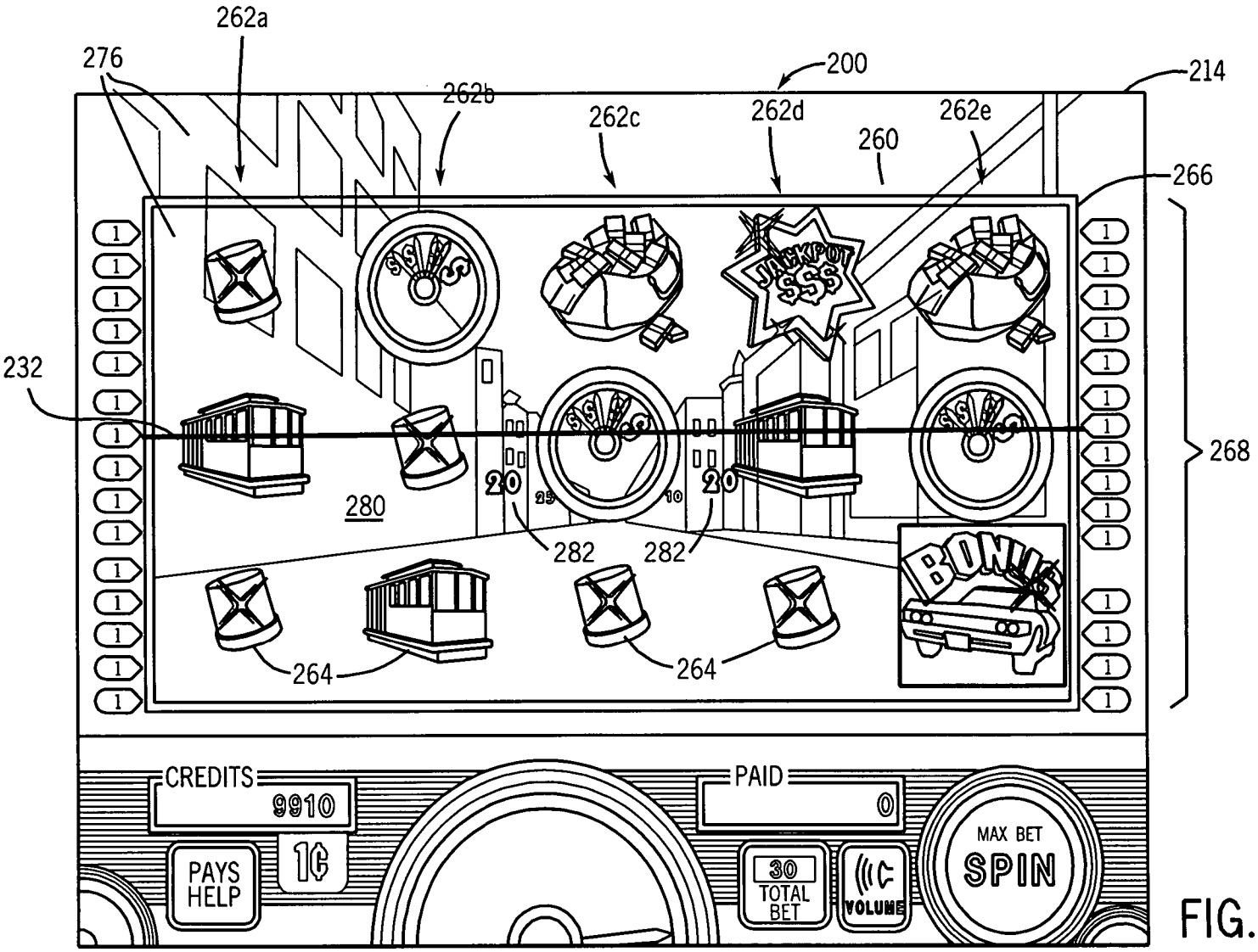
FIG. 5 is a screen shot of an alternative embodiment of a gaming system with a primary wagering game overlying an animated background.

An alternative embodiment of a gaming system 200 is described herein with reference to FIGS. 5-12. Turning to FIG. 5, a primary display 214 of the gaming system 200 displays a wagering game 260, which in this embodiment is a slot game. The slot game 260 includes a plurality of reels 262*a,b,c,d,e*. The reels 262 include a plurality of primary symbols 264 displayed thereon. One or more active paylines 232 pass through and extend across the reels 262. As described herein the symbols 264 landing on the active paylines 232 (the paylines for which a wager has been received) are evaluated for winning combinations. If a winning combination of symbols 264 lands on an active payline 232, a primary award is awarded in accordance with a paytable of the gaming device.

As seen in FIG. 5, the five reels 262 are positioned within a symbol window 266, which borders the reels 262 and the symbols 264 displayed thereon. In this embodiment, a matrix 268 of fifteen symbols 264 are displayed inside of the symbol window 266 surrounding the five reels 262. The matrix 268 of symbols includes three rows and five columns of symbols 264. The symbol window 266 overlies a background layer 276 displayed on the display 214. The symbols 264 have transparent or translucent symbol backgrounds such that the background layer 276 is visible through the symbol window 266. The background layer 276 depicts a background scene 280 which is displayed behind the symbols 264. In this embodiment, the background scene 280 is larger than the symbol window 266 and extends beyond the boundaries of the symbol window 266 so that it can be seen outside of the window 266. In other embodiments, the background scene 280 may be the same size or smaller than the symbol window 266.

The background scene 280, in an embodiment, is thematically related to a theme of the gaming system 200, which may also be shared with a theme of a the primary wagering game 260, such as the theme of the symbols 264. As seen in FIG. 5, the theme of the gaming system 200 and symbols 264 is a police detective theme, and the background scene 280 depicts a police car navigating city streets and buildings where the action of the thematic story takes place. The background scene 280 may be static depicting a fixed view or picture of the background scene, or may be animated and/or dynamic depicting multiple views, or a moving view of the background scene, for example, by use of a virtual camera for example, as seen in FIGS. 5-12. Moreover, the background scene 280 may be depicted as a two dimensional image or may be a 3-D image rendered by capturing one or more views from one or more virtual cameras. In an embodiment, a plurality of awards 282 are dispersed throughout the background scene 280. The plurality of awards 282 may be credit amounts as seen in the FIGURES, or may alternatively be icons, symbols, or other graphical displays representing awards of credits, multipliers, symbol upgrades, cash prizes, tangible prizes, etc.

Figure 6:
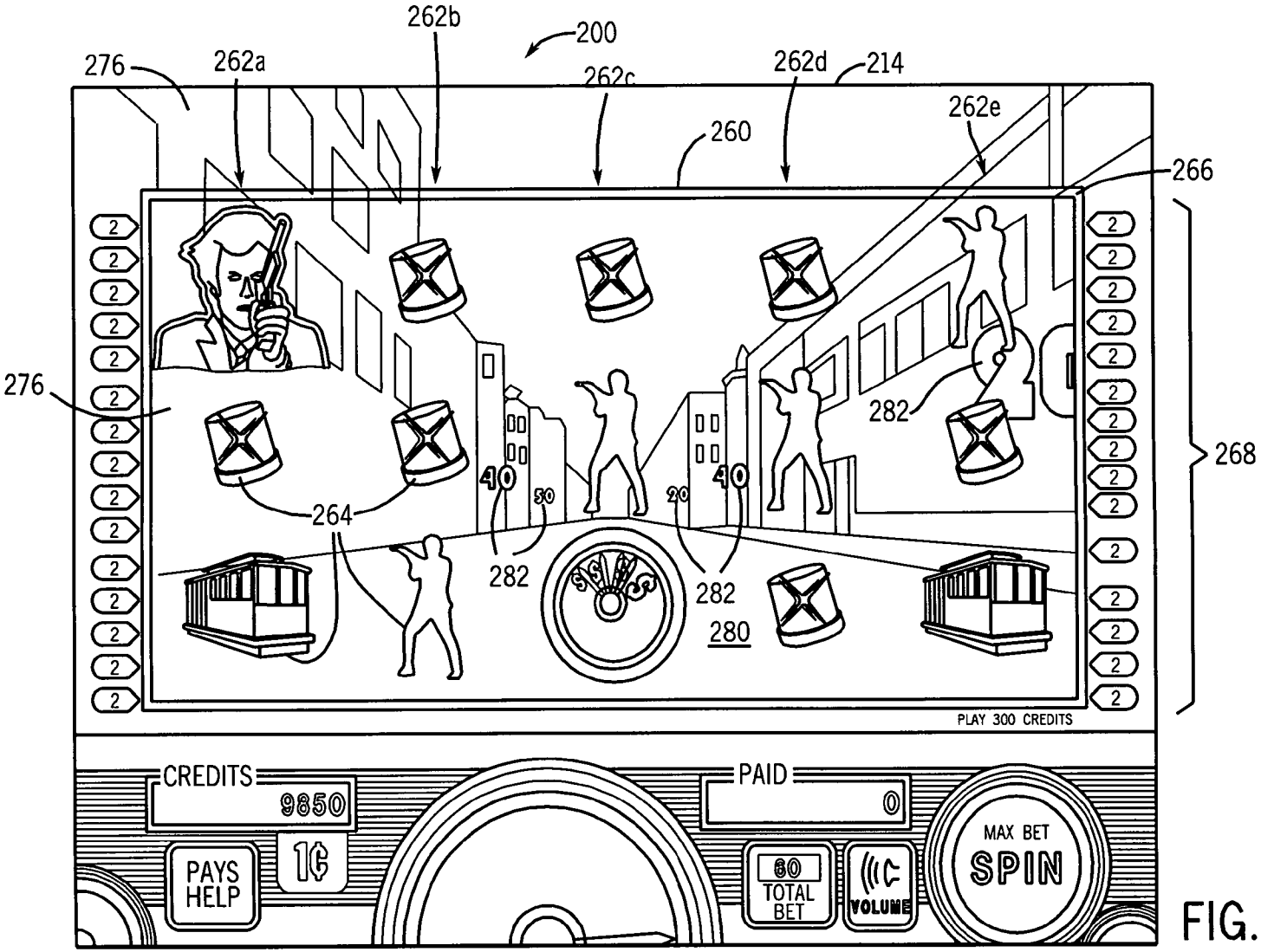
FIG. 6 is a screen shot of another play of the primary wagering game of FIG. 5.
Figure 7:
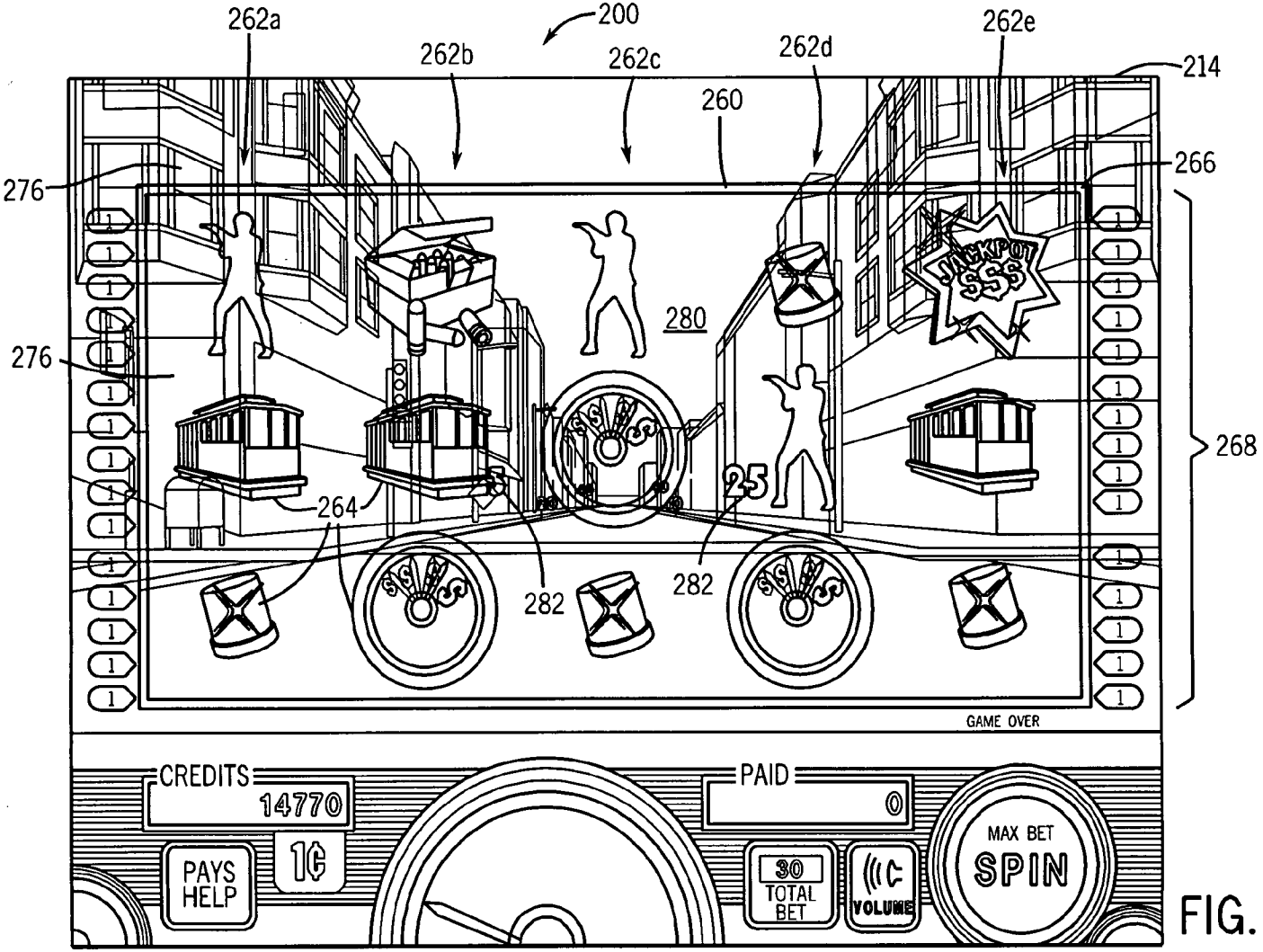
FIG. 7 is a screen shot of yet another play of the primary wagering game of FIG. 5.

In FIGS. 6 and 7, two randomly selected outcomes of the primary wagering game 260 are displayed. In FIG. 6, the wagering game 260 is displayed at a point in time later than the outcome displayed in FIG. 5. As can be seen, the background scene 280 is different. The police car (the virtual camera vantage point) has advanced further along the street in the background scene 280 and the displayed awards 282 are now different, both in amount and location. This has occurred due to the movement of the virtual camera through the background scene 280, which has caused the awards 282 in FIG. 5 to disappear, and new awards 282 positioned deeper in the background scene 280 to appear in FIG. 6. Similarly, in FIG. 7, another later point in time is displayed. Yet another outcome of the wagering game 260 is displayed. The awards 282 and the background scene 280 have again both changed due to the continued movement of the virtual camera through the virtual world. Thus, as a player observes multiple plays of the primary wagering game 260 on the primary display 214, the virtual world and background scene 280 on the background layer 276 continue to change through animation, including various awards 282 entering and leaving the screen.

Figure 8:
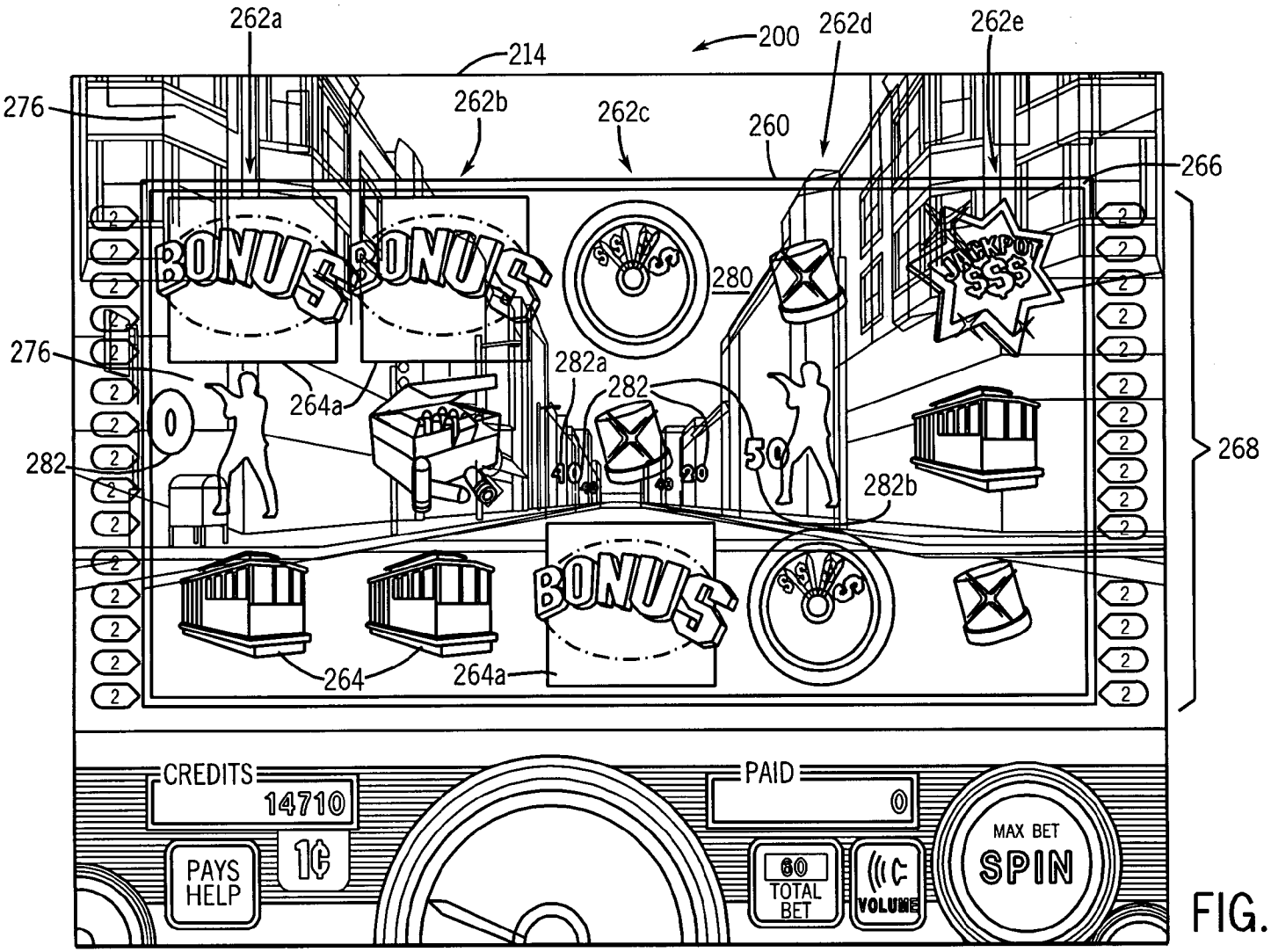
FIG. 8 is a screen shot of a bonus triggering outcome of a primary wagering game.

In FIG. 8, a triggering event has occurred which causes a bonus event to commence. In this embodiment, the triggering event is three or more "bonus" symbols 264*a* appearing in the matrix 268 of symbols 264. In other embodiments, any variety of triggering events may be utilized. For example, the triggering event may be alignment of bonus symbols on active payline. In yet other embodiments, the bonus event may be triggered randomly, at certain time intervals, or by other triggering mechanisms, such as time on device, accumulation of points or credits, etc. The background scene 280 continues to flow as the virtual camera traverses the streets and buildings in the virtual world of the background scene 280. Similarly, the awards 282 displayed in the background scene 280 continue to move off the display 214 and enter the display 214, as the background scene 280 is varied.

Figure 9:
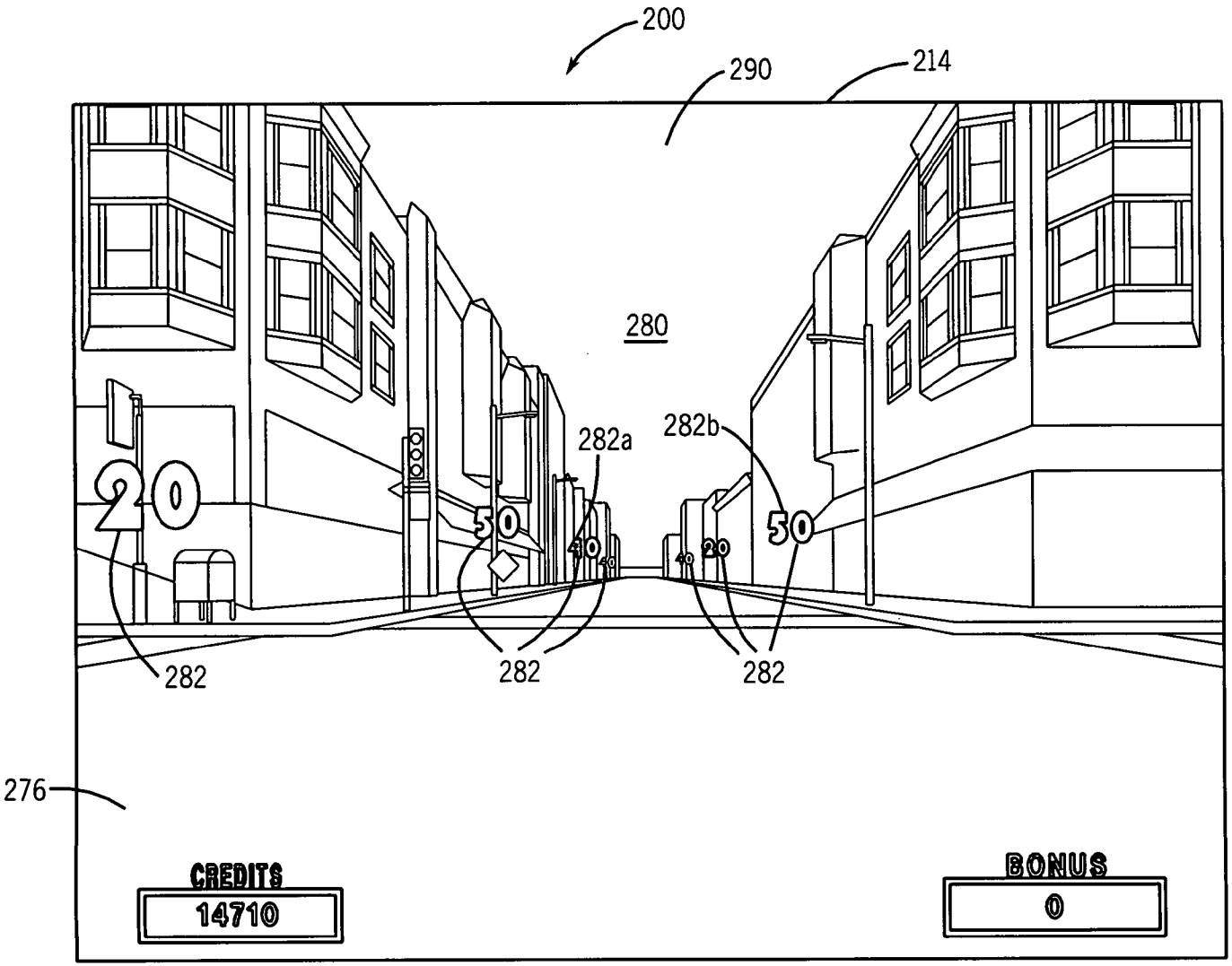
FIG. 9 is a screen shot of an initial screen of a bonus game.

In FIG. 9, the triggered bonus event 290 is displayed. The bonus event 290 is conducted utilizing the virtual world shown in the background scene 280. In an embodiment, the symbols 264 and the reel window 266 are lifted off of the display 214 or otherwise removed. Such removal may include entertaining animation or other graphics, or the symbols 264 and reel window 266 may be simply erased and removed from the display 214 to reveal the background scene 280 and commence the bonus event 290. As can be seen in the transition shown from FIG. 8 to FIG. 9, the background scene 280 remains the same as the display 214 transitions from the primary wagering game 260 to the bonus event 290. In other words, the background scene 280 and the awards 282 displayed therein are graphically in the same position as the symbols 264 are removed and the bonus even 290 begins. This provides a seamless transition from the wagering game 260 to the bonus event 290, such that a player viewing the display 214 sees the background scene 280 and awards 282 behind the wagering game 260 when the triggering event occurs, and continues to see the background scene 280 and awards 282 as the display transitions to the bonus event 290. Thus, in an embodiment, a first award 282*a* and a second award 282*b* respectively are in the same position when the bonus event 290 is triggered (FIG. 8) and when the bonus event 290 commences (FIG. 9).

Figure 10:
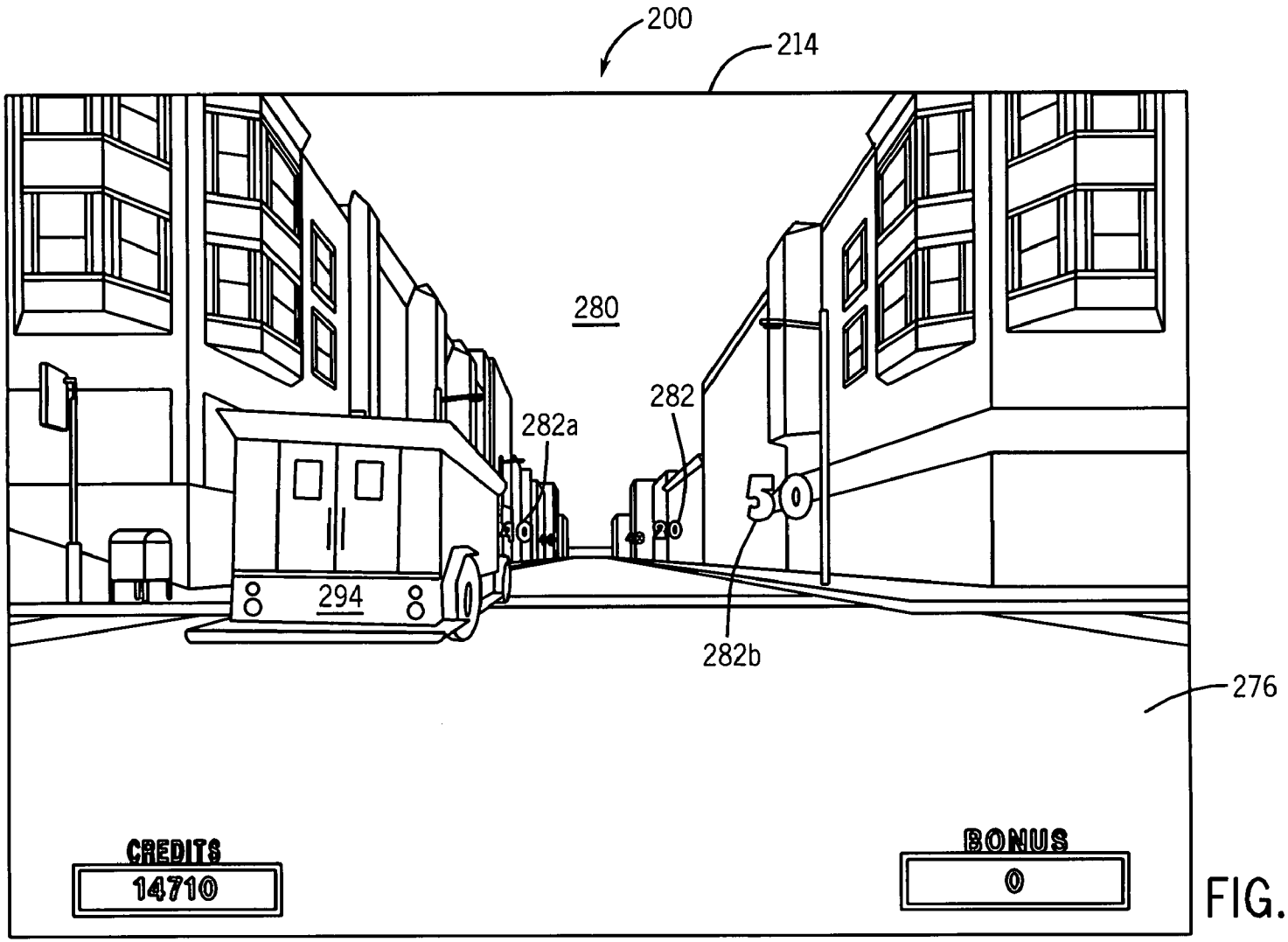
FIG. 10 is a screen shot of a subsequent screen of the bonus game of FIG. 9.
Figure 11:
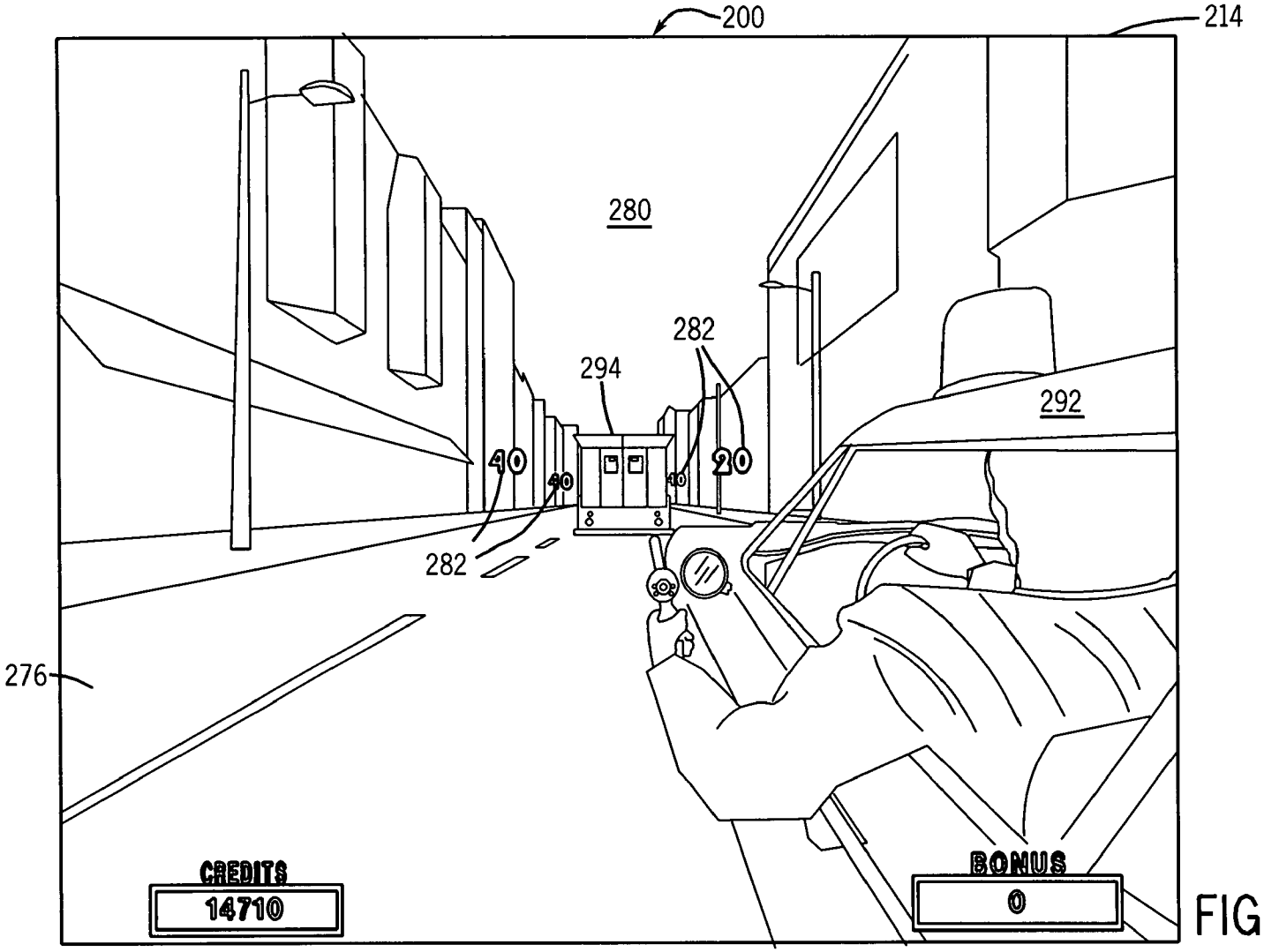
FIG. 11 is a screen shot of another subsequent screen of the bonus game of FIG. 9.
Figure 12:
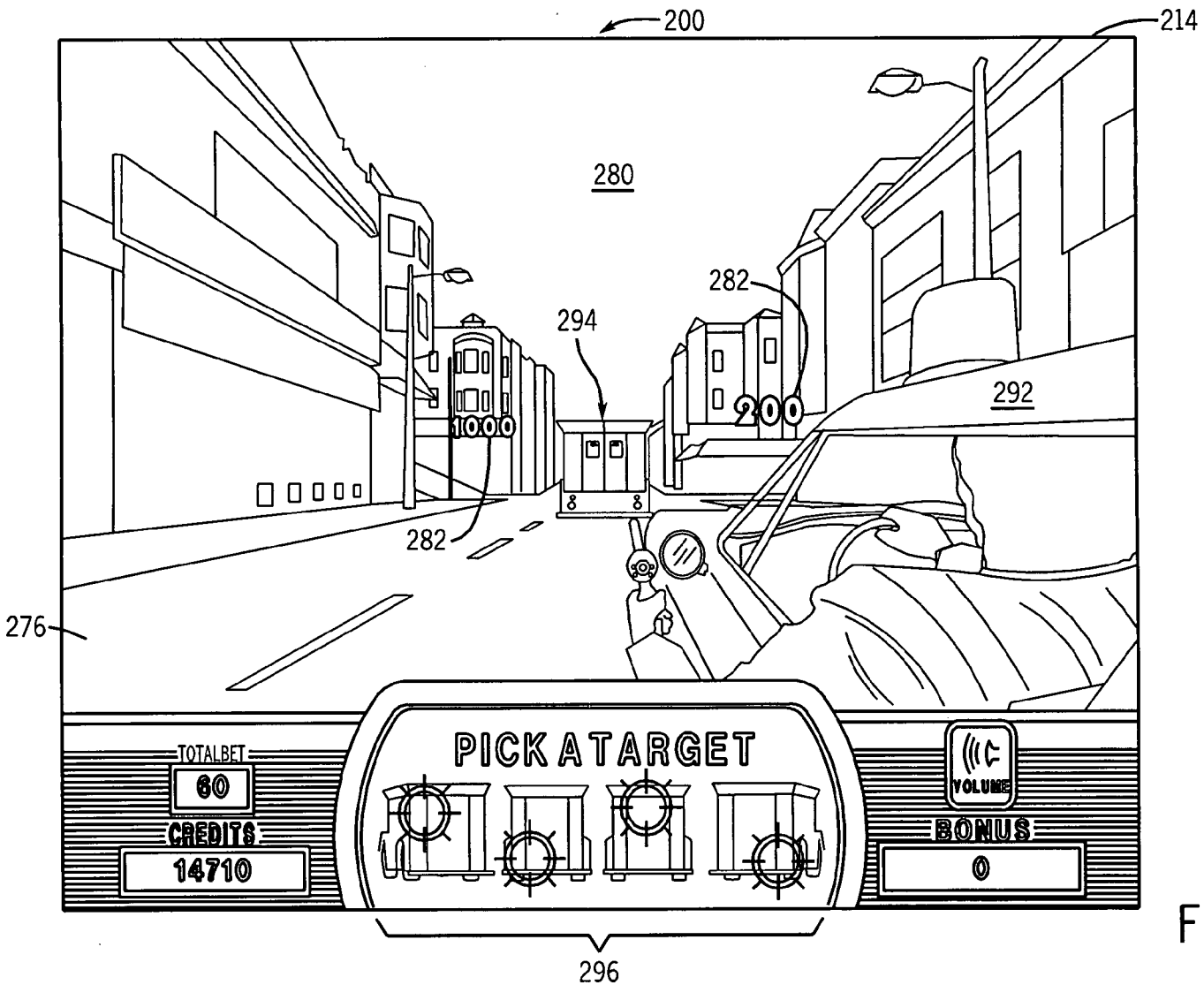
FIG. 12 is a screen shot of yet another subsequent screen of the bonus game of FIG. 9.

In the FIGURES shown, the bonus event 290 involves a chase scene between a police car 292 and a thief fleeing in another vehicle 294. In FIG. 10, the thief's vehicle 294 enters the background scene 280 fleeing from the police car 292 which is seen in FIG. 11. A plurality of awards 282 are still visible as the vehicles 292,294 traverse the streets of the background scene 280. In FIGS. 11 and 12, the police car 292 fires gunshots at the fleeing vehicle 294 in an effort to apprehend the suspect. In FIG. 12, a plurality of player selections 296 may be provided which in this embodiment allow the player to select where to shoot at the fleeing vehicle 294. It should be understood that the timing and direction of the shots fired by the police car 292 may be computer selected or received via player input. The shots fired at the fleeing vehicle 294 cause it to swerve and perform other maneuvers which cause the fleeing vehicle 294 to strike or come into contact with the awards 282 as the vehicles 292,294 navigate the background scene 280. The awards 282 which are struck by the fleeing vehicle 294 are awarded to the player. Thus, the size of the awards 282 won by the player will be affected by the player selection input 296, and the locations of the awards 282 within the background scene 280.

In alternative embodiments, other configurations are possible. For example, the primary wagering game 260 need not be a slot game, and be any form of wagering game capable of being graphically displayed overlying the background scene 280 and background layer 276. For example, the primary wagering game 260 could be a poker game, a dice game, a picking game, or any other game utilizing symbols displayed on the primary display 214. Moreover, the symbols of the primary wagering game 260 need not be located on reels, as shown in the FIGURES. Instead, the symbols may cascade or fall into the array 268 from any of the edges of the symbol window 266, or may otherwise be presented so as to complete, form and display a set of symbols capable of evaluation for winning combinations.

This embodiment of the invention provides an exciting chase scene in which a player is awarded credits for his efforts in apprehending a suspect in a fleeing vehicle 294. The gaming system 200 of this embodiment provides a number of advantages in that the awards 282 and background scene 280 are visible on the background layer 276 even prior to the bonus even 290 commencing. Thus, as the awards 282 pass by on the background layer 276 during the primary wagering game 260, a player experiences additional excitement and anticipation that the triggering event will occur when the awards 282 are large. The added benefit of a smooth transition from the wagering game 260 to the bonus event 290 further heightens the enjoyment of the gaming system 200. Thus, a player sees the awards 282 of the background scene 280 dynamically flying by, achieves a triggering event to enter the bonus event, and then seamless transitions into the bonus event wherein the awards 282 displayed on the background scene 280 continue to be displayed as the bonus event 290 commences.

Figure 13:
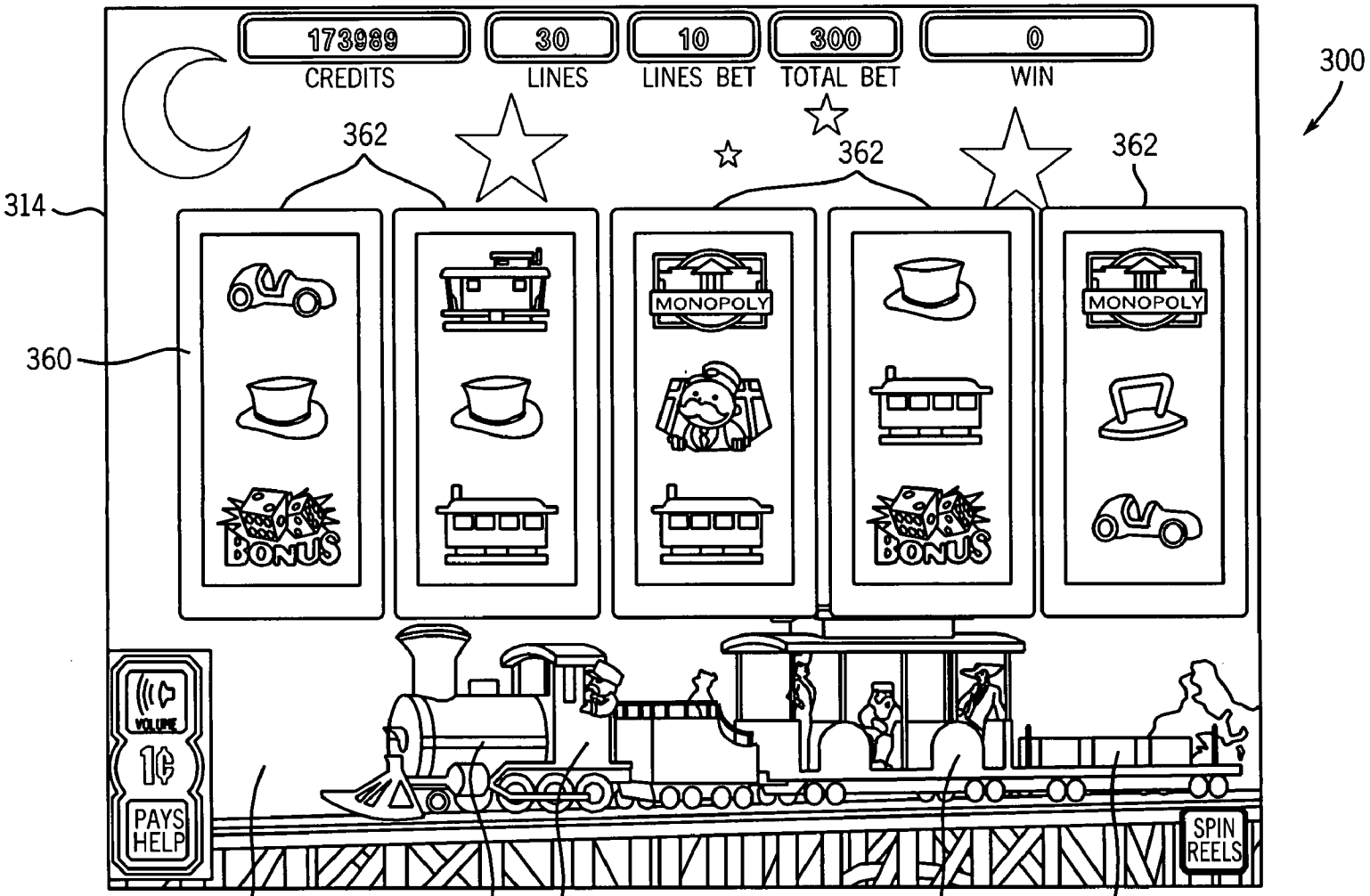
FIG. 13 is a screen shot of a gaming system of an alternative embodiment having a animated wallpaper.

Yet another alternative embodiment of a gaming system 300 is shown in FIGS. 13-21. In FIG. 13, a primary display 314 of the gaming system 300 is depicted displaying a primary wagering game 360. Similar to the embodiment in FIG. 3, the primary wagering game 360 is a slot game displaying a plurality of symbol bearing reels 362. In addition to the reels 362, the primary display 360 displays a wallpaper 380. The wallpaper 380 may be a background scene or bordering scene surrounding the primary wagering game 360. As with other embodiments, the wallpaper 380 may be static, or may be dynamic showing various elements which are in motion, changing in size, animated, etc. The wallpaper 380 may be accompanied by music or sound effects. In this embodiment, the wallpaper 380 is a dynamic background scene of a train 382 which traverses through various environments. The train 382 includes a plurality of train cars 384*a,b,c*, each of which represents or may be associated with a different bonus game or award, in this embodiment.

As play of the primary wagering game 360 occurs, the train 382 on the wallpaper 380 is animated so as to travel through various environments (e.g., night time scenes, day time scenes, city scenes, country and pasture scenes, etc.). In this way, the wallpaper 380 provides an amusing and entertaining background scene which is visually enjoyable to a player of the primary wagering game 360. During play of the primary wagering game 360, the wallpaper 380 continues this entertaining display in a passive fashion until a triggering event causes one or more bonus events to occur. In an embodiment, the bonus events include displays of portions of the wallpaper 380, such as the cars 384 of the train 382 in this embodiment, as described with reference to the FIGURES.

Figure 14:
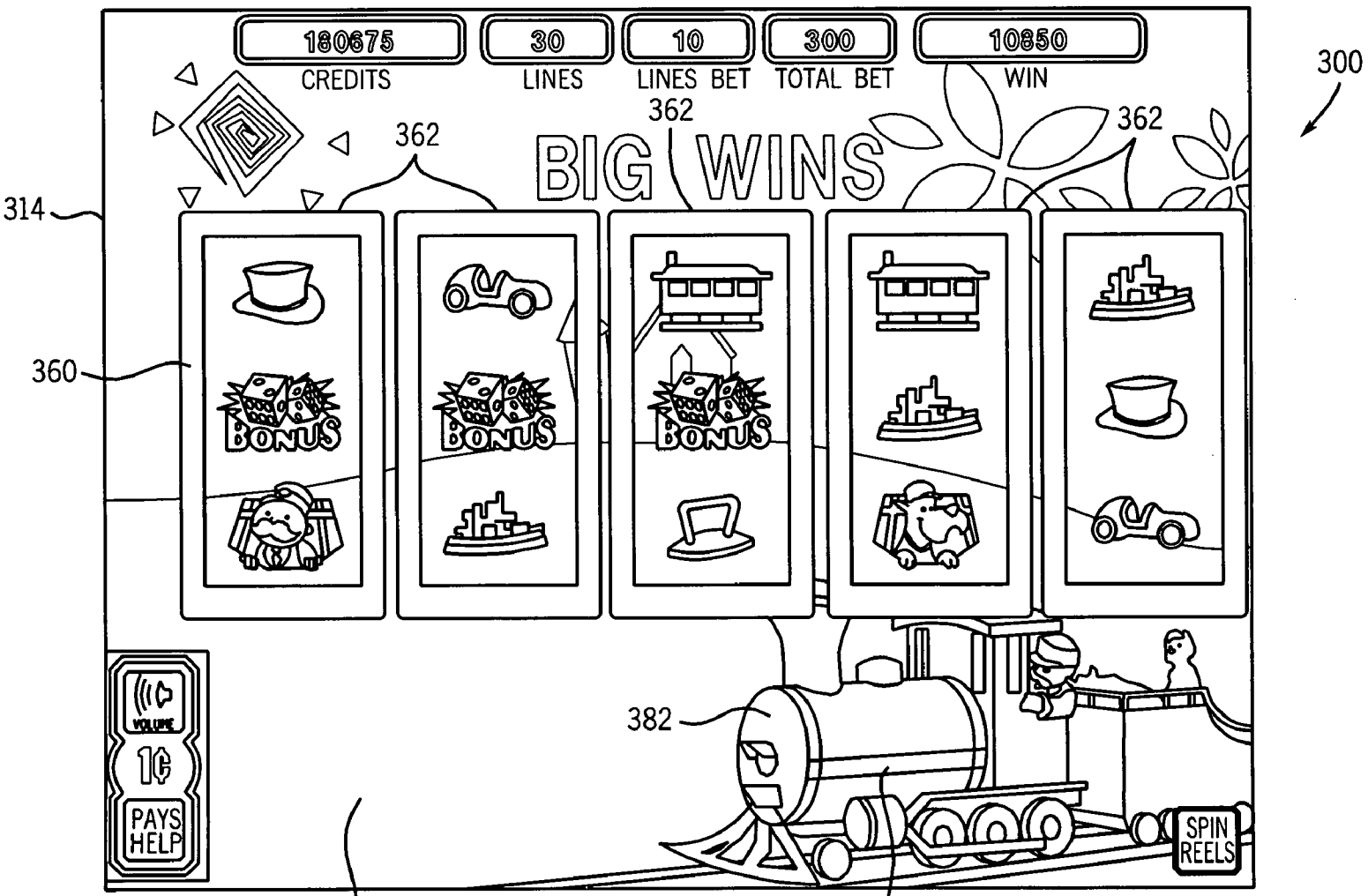
FIG. 14 is a screen shot of a first bonus event depicted on a portion of the wallpaper of FIG. 13.

Turning to FIG. 14, a first triggering event has occurred comprising three "bonus" symbols aligned on the middle row of the reels 362. The first triggering event has caused a first bonus event to occur and be displayed. The first bonus event involves a bonus game which is depicted to include the engine 384*a* of the train 382, and the engineer character operating the engine 384*a*. Thus, the wallpaper 380 changes such that a virtual camera zooms in for a closer shot and view of the first car 384*a* of the train 382 to display the first bonus event. Therefore, as the first bonus event is triggered, a change in view of the wallpaper 380 occurs such that an element of the wallpaper 380 becomes the focal viewpoint of the background display, so as to display the first bonus event.

Figure 15:
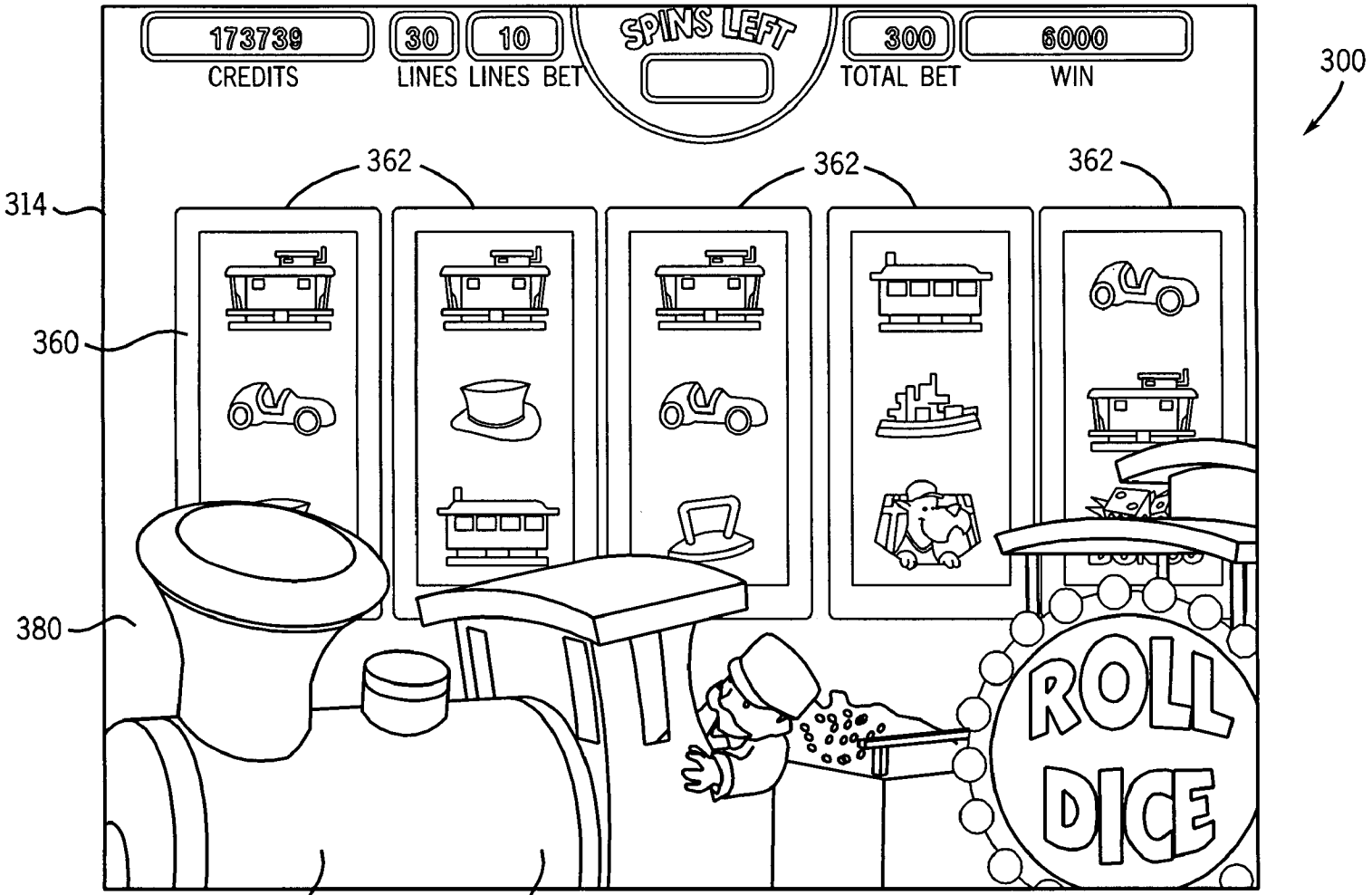
FIG. 15 is a further screen shot of the first bonus event of FIG. 14.
Figure 16:
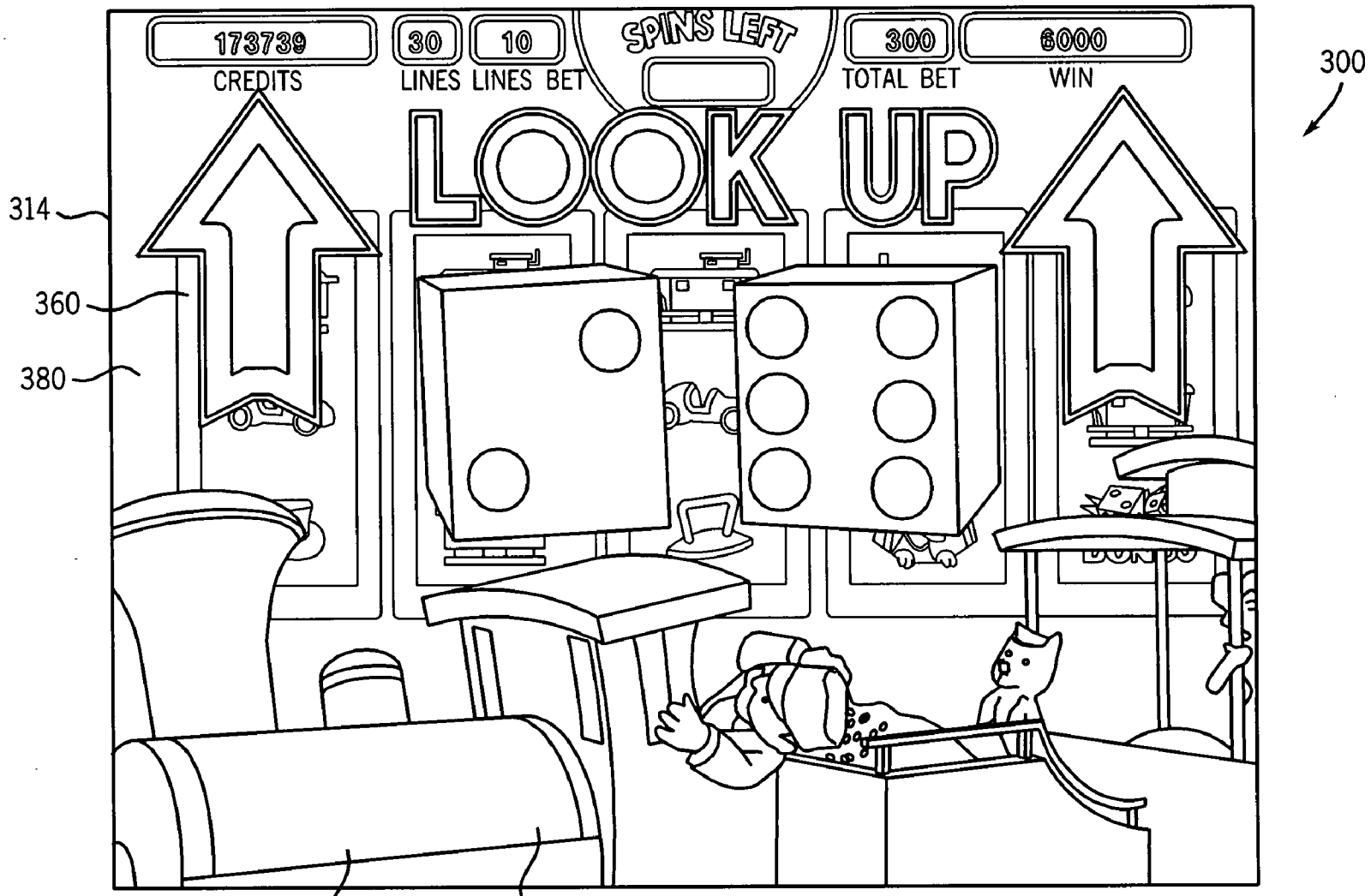
FIG. 16 is yet a further screen shot of the first bonus event of FIG. 14.

As seen in FIG. 15, the engine 384*a* of the train 382 is even further enlarged to depict the first bonus event which includes a dice roll by the player, which is executed by the engineer of the train 382. A "Roll Dice" button appears on the lower right hand corner of the display 314, which is activated by a player input causing the first bonus event to commence, thereby causing a roll of the dice. As the player initiates the dice roll, an animation occurs, as seen in FIG. 16, causing the engineer of the train 382 to cause a pair of dice to roll and display a result on the primary display 314. For example, a pair of dice may shoot out of the stack of the locomotive and come to rest as seen in FIG. 16. In FIG. 16, the player has rolled an "eight" (8), and the primary display 314 includes instructions to the player to "Look Up" to watch the remainder of the first bonus event. In this embodiment, the first bonus event further includes a display of a board game event on a secondary display (not shown) mounted above the primary display 314. Thus, the player is instructed to look up so as to watch and enjoy the display of the remainder of the first bonus event.

Figure 17:
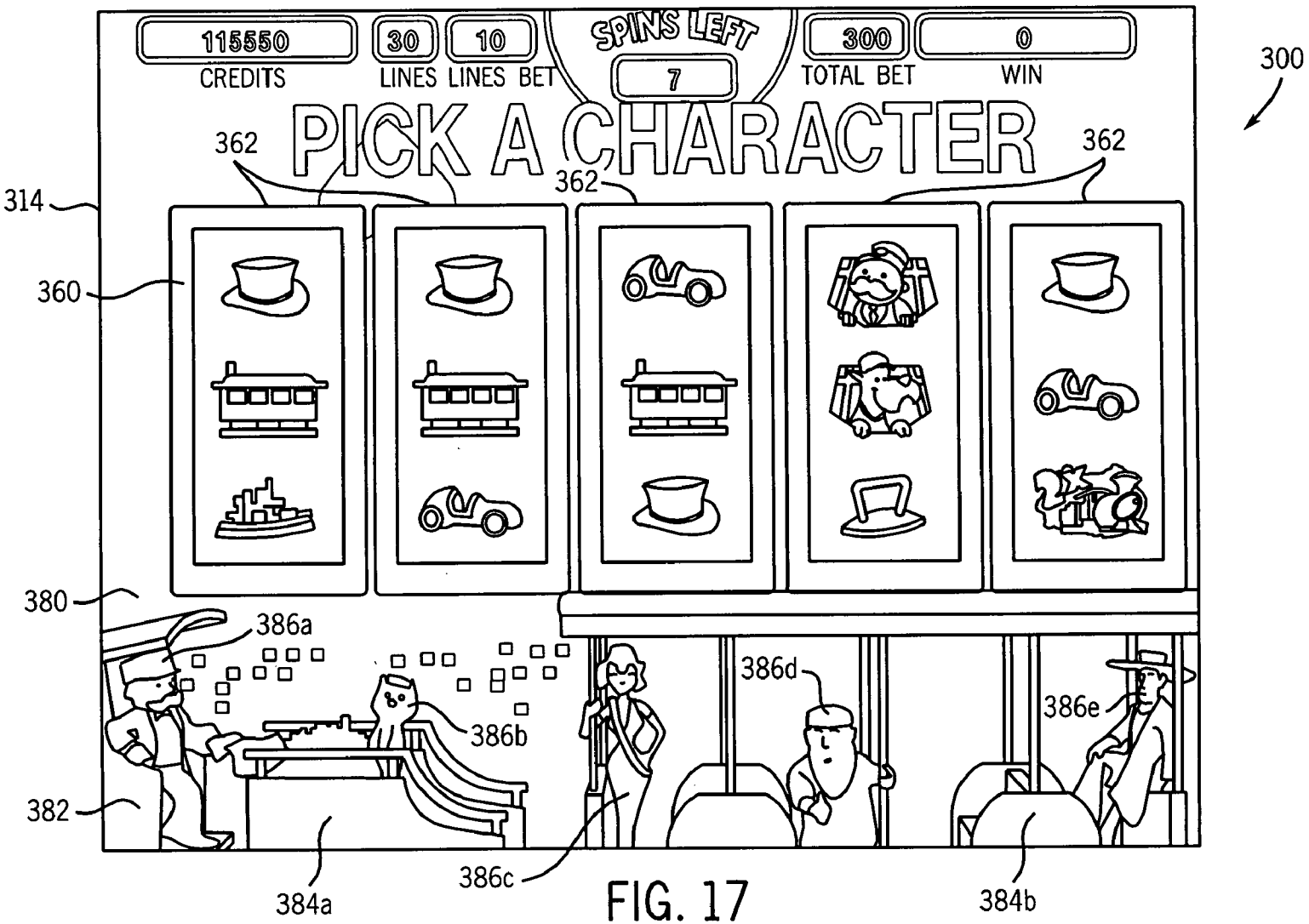
FIG. 17 is a screen shot of a second bonus event depicted on another portion of the wallpaper of FIG. 13.

In FIG. 17, the primary wagering game 360 of FIG. 13 is shown again, displaying a different outcome of the primary wagering game 360, which is a second triggering event. The second triggering event comprises three "train car" symbols aligned on the middle row of the reels 362, and triggers a second bonus event. As seen in FIG. 17, the second bonus event is a selection game that involves characters 386 on the engine 384*a* and second car 384*b* of the train 382. Thus, that portion of the train appears onscreen and once again the virtual camera is repositioned so as to zoom into the portion of the wallpaper 380 upon which the second bonus event is conducted. In this instance, the camera zooms into a side view of a portion of the engine 384*a* and the second car 384*b* and depicts five characters 386 riding on the train 382. The player is instructed to "Pick A Character" by the primary display 314. The player provides a selection input to select one of the five available characters 386*a-e*. In this instance, the player selects the female character 386*c* in the center of the display 314.

Figure 18:
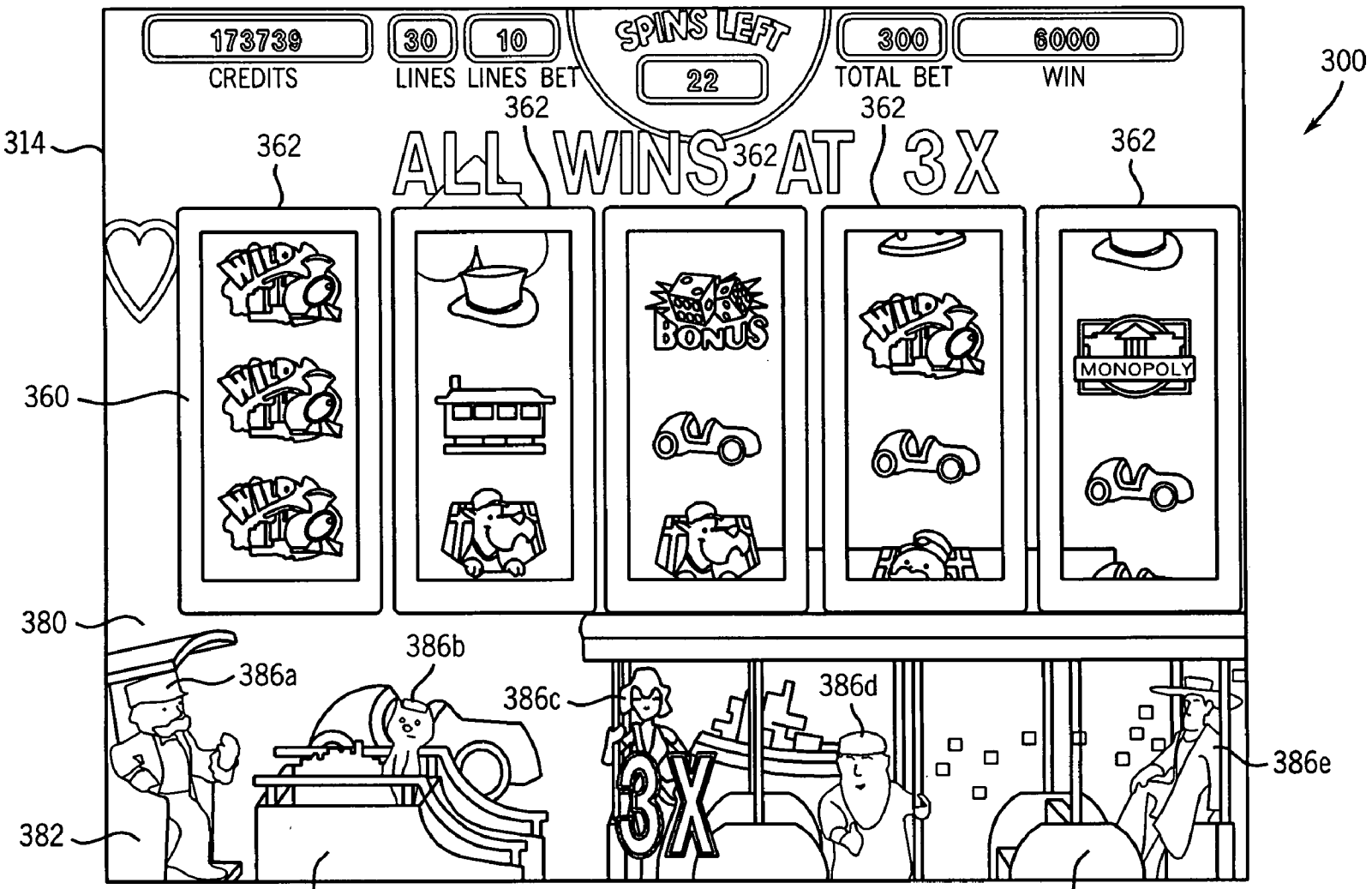
FIG. 18 is a further screen shot of the second bonus event of FIG. 17.

Turning to FIG. 18, in response to the selection input of the player, the awards associated with the selectable characters 386*a-e* are revealed. The player receives a "3×" multiplier award associated with the selected character 386*c*. In another embodiment, the player may also permitted to view the awards associated with the unselected characters 386*a,b,d,e*. The 3× multiplier award is awarded to the player and the primary display 314 informs the player that he or she will receive a set of free spins, and that all awards earned during the free spins will be multiplied by three. Specifically, the primary display 314 states "All Wins at 3×." The second bonus event thus comprises a set of free spins (not shown) which are modified or improved by a multiplier awarded to the player during the selection game depicted in FIGS. 17 and 18. Again, the second bonus event is depicted on a sub-portion of the wallpaper 380 shown during the play of the primary wagering game 360.

Figure 19:
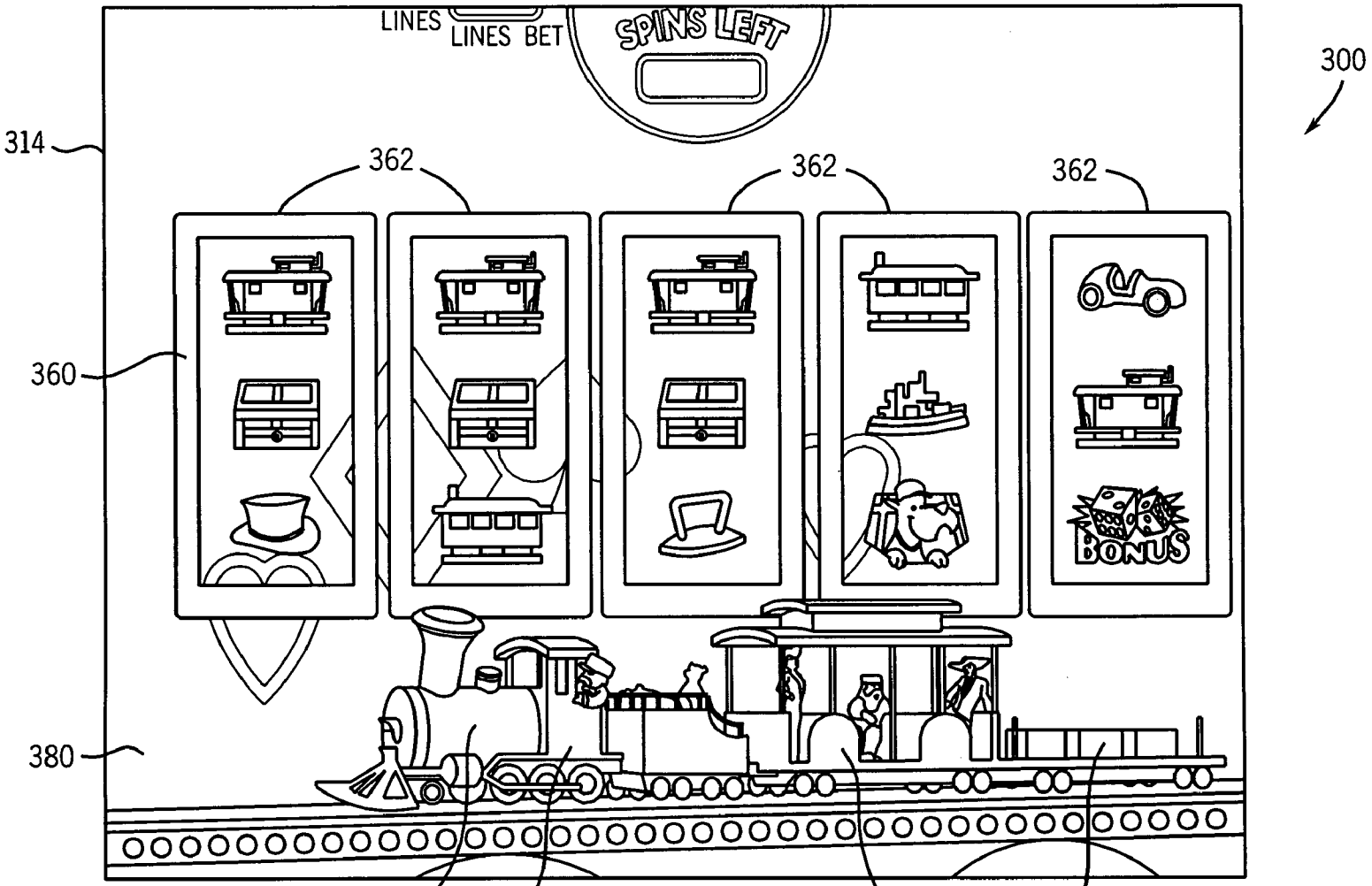
FIG. 19 is a screen shot of the gaming system of FIG. 13 depicting the triggering of a third bonus event.
Figure 20:
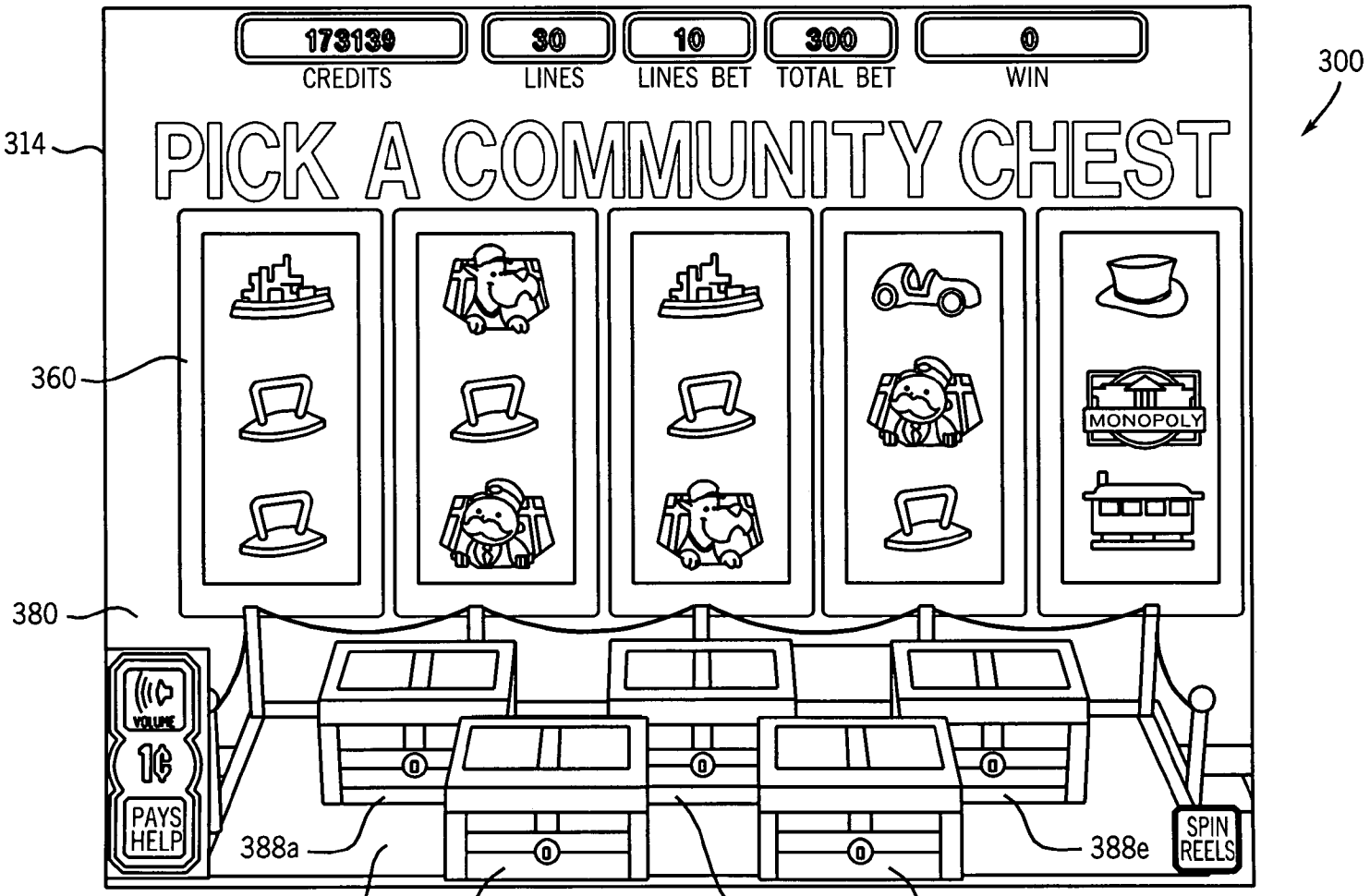
FIG. 20 is a screen shot of a third bonus event.

In FIG. 19, the primary display 314 is again shown depicted the primary wagering game 360 of FIG. 13. In this instance, another outcome has caused a third triggering event to occur. Three "Community Chest" symbols have aligned on the active payline traversing the middle row of symbols on the reels 362, thereby triggering a third bonus event. In this instance, the third bonus event is depicted in part on a third car 384*c* of the train 382, which includes a plurality of chests 388*a-e* from which a player may select. Thus, the virtual camera zooms in to display the third car 384*c* of the train 382, and the selectable elements (chests 388*a-e*) thereon, as seen in FIG. 20. Again, the third bonus event is conducted on a sub-portion of the wallpaper 380, which in this case is yet another car 384 of the train 382. The primary display 314 instructs the player to "Pick A Community Chest" and the system 300 waits to receive a player selection input.

Figure 21:
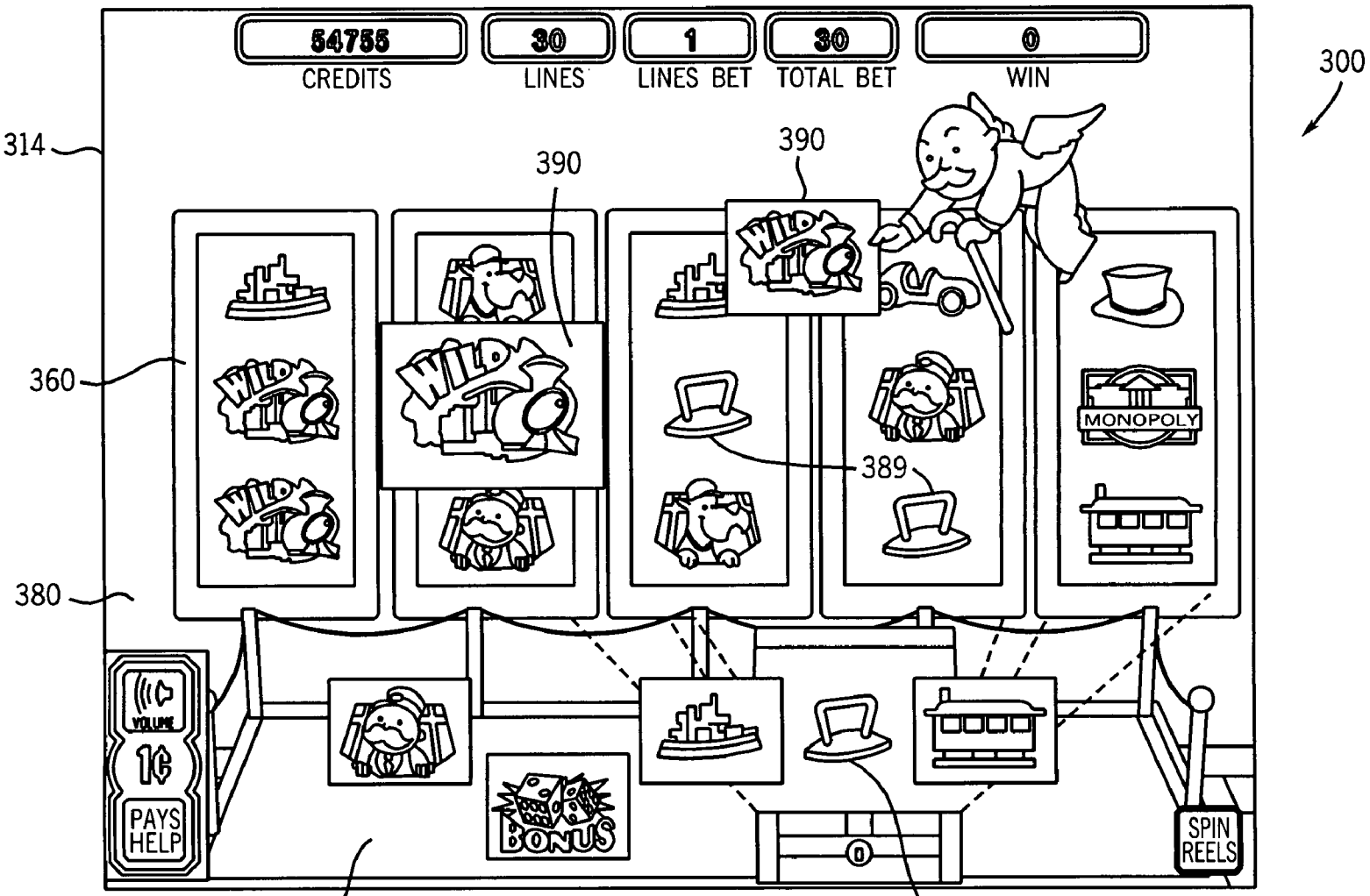
FIG. 21 is a further screen shot of the third bonus event of FIG. 20.

In FIG. 21, the player has selected the fourth chest 388*d*, which is opened to reveal a symbol 389, which in this case is an "iron" symbol. The awarded symbol 389 is shown along with the symbols associated with the unselected chests 388*a, b,c,e*. The awarded symbol 389, in this embodiment, is designated as a wild symbol, and thus an animation occurs in which all occurrences of the award symbol 389 on the reels 362 are replaced with a wild symbol 390. Thus, as seen in FIG. 21, the animation includes a Mr. Monopoly character flying across the reels 362 and replacing all occurrences of the awarded "iron" symbol 389 with a wild card symbol 390. In doing so, the third bonus event provides additional wild symbols 390 to the player, which increases the likelihood that the symbols on the reels 362 will form wining outcomes for which the player will receive additional awards. Thus, the third bonus event is a symbol replacement event in which a selected symbol 389 is replaced by wild symbols 390 in an effort to create additional winning combinations.

In each of the first, second and third bonus events, the virtual camera moves, in, zooms, and/or changes angle so as to focus on and highlight a sub-portion of the wallpaper 380 on which the associated bonus event is conducted and/or displayed. It should be understood that various available bonus events may be conducted on the same or differing portions of the wallpaper 380, or may overlap. The virtual camera may zoom in, change angles, zoom out, or otherwise navigate through the environment of the wallpaper 380 so as to display the relevant bonus event. Moreover, more than one virtual camera may be utilized to change the view of the wallpaper 380 from the general view (such as that in FIG. 13) to the specific bonus event views. It should be further understood that the virtual camera may move prior to, during, and after the conducting of the relevant bonus event, and that the views depicted may change from one virtual camera to another so as to focus on various portions of the bonus event. In alternative embodiments, the wallpaper 380 can take on many different forms, and have many different visual and graphical displays thereon. In the spirit of this embodiment of the invention, bonus games are conducted on sub-portions of the wallpaper 380 as desired to be displayed by one or more virtual cameras which change or alter the viewpoint and/or display of the wallpaper 380 to focus on such triggered bonus event.

In an alternative embodiment of the invention, one or more portions of the display of a gaming system may present a real time video broadcast or clip. The video broadcast or clip may be presented in streaming fashion so as to depict a display of an event which is happening in real time, or near real time, as opposed to re-broadcast or regeneration of a prerecorded event. For example, a live broadcast of a news broadcast or sporting event may be streamed into the system and presented on all or a portion of one or more of the displays. The system may further include a server, computer, or other storage components which provide a plurality of available real time video sources from which an operator or player may select. The displayed real time video may be presented as part of a background scene, a wallpaper, etc. Moreover, the real time video may overly a portion of other elements on the display, such as the reels of a primary wagering game. In yet other embodiments, the real time video may be layered and appear visible through or behind other translucent or transparent elements on the display. Many customization options may be provided to a player or operator regarding the positioning, location, size, and number of real time videos displayed, as well as the content therein. Moreover, the real time video may be incorporated onto the primary display, a secondary display, or may appear on a dedicated display of a gaming device or other component of the system.

The gaming system of the present invention offers a number of benefits over traditional gaming machines. First, in addition to traditional credit awards, the system offers intangible prizes through the additional visibility and graphical display that is achieved by changing the translucence of the symbol backgrounds. Second, the dynamic nature of the symbols 64 and backgrounds 74 induces additional excitement to the player who is only permitted to see discrete parts of the wallpaper 80 at a time. This causes the player to lengthen his gaming session in order to view the entire wallpaper 80 over multiple plays of the gaming system. Finally, the system offers the owner or operator of the gaming system a number of customizable graphical elements. For example, the wallpaper 80 background may be themed to the casino where the gaming system is placed, or to any other graphical presentation, such as advertisements, entertainment programming, video clips, etc.

Each of these embodiments and obvious variations thereof is contemplated as falling within the spirit and scope of the claimed invention, which is set forth in the following claims.

What is claimed is:

1. A gaming system comprising:

a wager input device;

a display for displaying a wallpaper, a plurality of symbols, and a plurality of symbol backgrounds, the symbols overlying the symbol backgrounds, the symbol backgrounds overlying the wallpaper, the plurality of symbols representing a randomly selected outcome of a wagering game; and a controller operative to increase a translucence of at least one of the symbol backgrounds to increase visibility of the wallpaper in response to a triggering event, wherein the wallpaper comprises an animated background scene having a plurality of awards;

wherein the controller is configured to continue animation of the background scene during one or more plays of the wagering game; and wherein, upon the occurrence of the triggering event and increasing of the translucence of at least one of the symbol backgrounds to increase visibility of the wallpaper animated background scene, the controller is further configured to display a bonus event including continued display of the animated background scene.

2. The gaming system of claim 1, wherein the triggering event is the randomly selected outcome being a winning outcome.

3. The gaming system of claim 2, wherein the winning outcome includes a plurality of winning symbols, wherein the at least one symbol background underlies with one of the plurality of winning symbols.

4. The gaming system of claim 1, wherein the translucence of the at least one symbol background is increased from a nearly opaque state to a substantially transparent state.

5. The gaming system of claim 1, wherein the wallpaper is displayed in 3-D.

6. The gaming system of claim 5, wherein the wallpaper is a continuously changing 3-D animation.

7. A method of conducting a wagering game on a gaming system, the method comprising:

receiving a wager via a value input device;

displaying on a display a wallpaper comprising an animated background scene having a plurality of awards, a plurality of symbols, and a plurality of symbol backgrounds, the symbols overlying the symbol backgrounds, the symbol backgrounds overlying the wallpaper, the plurality of symbols representing a randomly selected outcome of a wagering game, the wallpaper animated background scene being continued during a plurality of plays of the wagering game;

using one or more controllers for detecting a triggering event; and in response to the triggering event, using at least one of the controllers for changing on the display a first translucence of a first one of the symbol backgrounds to increase the visibility of the wallpaper during a bonus event, the bonus event including continued display of the animated background scene and an opportunity to win at least one of said plurality of awards displayed in the animated background scene.

8. The method of claim 7, wherein the changing step comprises increasing the first translucence of the first one of the symbol backgrounds.

9. The method of claim 8, further comprising maintaining a second translucence of a second one of the symbol backgrounds.

10. The method of claim 9, wherein the triggering event is the randomly selected outcome including a winning combination of symbols.

11. The method of claim 10, wherein the first one of the symbol backgrounds underlies one of the symbols in the winning combination.

12. The method of claim 11, wherein the second one of the symbol backgrounds underlies a symbol that is not part of the winning combination of symbols.

13. The method of claim 7, wherein the wallpaper changes dynamically over time.

14. A method of conducting a wagering game on a gaming system, the method comprising:

receiving a wager via a value input device;

displaying, on a display, a wallpaper comprising a dynamic, animated background scene;

displaying, on a display, further to the wallpaper, a matrix of symbols, the symbols overlying a plurality of symbol backgrounds, the symbol backgrounds overlying the wallpaper and permitting the background scene to be at least partly visible through the matrix of symbols, the matrix bordered by a symbol window, the plurality of symbols representing a randomly selected outcome of a wagering game, the randomly selected outcome selected from a plurality of possible outcomes including at least one winning outcome, the winning outcome comprising a plurality of winning symbols;

using one or more controllers for detecting if the randomly selected outcome is the at least one winning outcome;

using at least one of the controllers to continue animation of the animated background scene during one or more plays of the wagering game; and upon the occurrence of a triggering event, using at least one of the controllers for increasing a first translucence of the symbol backgrounds of the winning symbols to display a bonus event, the bonus event including continued display of the animated background scene, and to enhance the display of the wallpaper through the symbols and the symbol backgrounds.

15. The method of claim 14, wherein the wallpaper extends outside of the symbol window.

16. The method of claim 14, wherein the increasing step comprises increasing the translucence of the symbol backgrounds of the winning symbols from a nearly opaque state to a substantially transparent state.

17. The method of claim 14, further comprising maintaining a second translucence of a plurality of symbol backgrounds underlying symbols other than the winning symbols.

18. The method of claim 14, wherein the increasing step is performed by increasing an alpha channel value of the symbol backgrounds of the winning symbols.

19. The method of claim 14, wherein the wallpaper is thematically associated to a theme of the gaming system.

20. A gaming system comprising a physical computer readable storage medium encoded with instructions for directing the gaming system to perform acts comprising:

registering a wager via a value input device;

displaying, on a display of the computer system, a wallpaper comprising an animated background scene having a plurality of awards, displaying, on a display, further to the wallpaper, a matrix of symbols, the symbols overlying a plurality of symbol backgrounds, the symbol backgrounds overlying the wallpaper and permitting the background scene to be at least partly visible through the matrix of symbols, the matrix bordered by a symbol window, the plurality of symbols representing a randomly selected outcome of a wagering game, the randomly selected outcome selected from a plurality of possible outcomes including at least one winning outcome, the winning outcome comprising a plurality of winning symbols;

using one or more controllers for detecting if the randomly selected outcome is the at least one winning outcome;

using at least one of the controllers to continue animation of the animated background scene during one or more plays of the wagering game; and upon the occurrence of a triggering event, using at least one of the controllers for increasing a first translucence of the symbol backgrounds of the winning symbols to display a bonus event, the bonus event including continued display of the animated background scene, and to enhance the display of the wallpaper through the symbols and the symbol backgrounds.

21. A method of conducting a wagering game on a gaming system, the method comprising:

receiving a wager via a value input device;

displaying on a display an animated background scene having a plurality of awards;

using one or more controllers for overlying the background scene on the display with a primary wagering game, the primary wagering game including a matrix of symbols, the background scene visible through the matrix of symbols;

using at least one of the controllers for continuing animation of the background scene during one or more plays of the wagering game; and upon the occurrence of a triggering event, using at least one of the controllers for removing the matrix of symbols to display a bonus event, the bonus event including continued display of the animated background scene.

22. The method of claim 21, further comprising providing at least one prize in the bonus event, the at least one prize selected from the plurality of awards displayed in the background scene.

23. The method of claim 21, wherein an appearance of the background scene at the commencement of the bonus event is substantially the same as an appearance of the background scene upon conclusion of the triggering event.

24. The method of claim 23, further comprising maintaining the appearance of the background scene until the bonus event commences.

25. The method of claim 21, wherein the bonus event further comprises at least one additional visual element added to the background scene.

26. The method of claim 25, wherein the at least one additional visual element is thematically related to a theme of the primary wagering game.

* * * * *